US007737864B2

(12) United States Patent
Schnackenberg

(10) Patent No.: US 7,737,864 B2
(45) Date of Patent: Jun. 15, 2010

(54) TRAFFIC SIGNAL TRANSFER SWITCH WITH INTERLOCK CONSTRUCTIONS

(75) Inventor: Paul Schnackenberg, Cumming, GA (US)

(73) Assignee: Gen-Tran Corporation, Alpharetta, GA (US)

( * ) Notice: Subject to any disclaimer, the term of this patent is extended or adjusted under 35 U.S.C. 154(b) by 297 days.

(21) Appl. No.: 11/888,435

(22) Filed: Jul. 31, 2007

(65) Prior Publication Data

US 2008/0074287 A1 Mar. 27, 2008

Related U.S. Application Data

(63) Continuation-in-part of application No. 11/157,753, filed on Jun. 21, 2005, now Pat. No. 7,250,875.

(51) Int. Cl.
*G08G 1/095* (2006.01)

(52) U.S. Cl. ..... 340/907; 340/908; 340/693.1; 340/693.2; 340/333; 200/400; 200/401; 200/424; 200/307; 200/526

(58) Field of Classification Search ..... 340/907, 340/908, 693.1, 693.2, 333; 200/400, 401, 200/424, 307, 526
See application file for complete search history.

(56) References Cited

U.S. PATENT DOCUMENTS

| | | | |
|---|---|---|---|
| 704,336 | A | 7/1902 | IhIder |
| 805,057 | A | 11/1905 | Craft |
| 1,014,600 | A | 1/1912 | Kleinschmidt |
| 1,439,905 | A | 12/1922 | Lull |
| 2,229,729 | A | 1/1941 | Emde |
| D130,944 | S | 12/1941 | Fogel, Jr. |
| D134,994 | S | 2/1943 | Fetter |
| D134,996 | S | 2/1943 | Kaminky |
| D135,528 | S | 4/1943 | Meyer |
| 2,606,260 | A | 8/1952 | Frese |
| 2,612,789 | A | 10/1952 | Bierenfeld |
| 2,756,612 | A | 7/1956 | Schleicher |
| 2,841,666 | A | 7/1958 | Anderson |
| 2,865,017 | A | 12/1958 | Heikes |
| 2,997,691 | A | 8/1961 | Stoll |
| 3,041,420 | A | 6/1962 | Berry et al. |
| 3,149,210 | A | 9/1964 | Haydu et al. |
| D201,244 | S | 6/1965 | Tateisi |
| 3,210,491 | A | 10/1965 | Marco |
| RE26,113 | E | 11/1966 | Carter et al. |
| 3,432,628 | A | 3/1969 | Puetz |
| 3,510,612 | A | 5/1970 | Ward |
| D222,473 | S | 10/1971 | Zecca |
| 3,641,487 | A | 2/1972 | Rogers et al. |
| 3,697,709 | A | 10/1972 | Witkor |
| 4,013,849 | A | 3/1977 | Brown |
| 4,295,053 | A | 10/1981 | Kovatch et al. |
| 4,347,488 | A | 8/1982 | Mune et al. |
| 4,423,336 | A | 12/1983 | Iverson et al. |

(Continued)

*Primary Examiner*—Tai T Nguyen
(74) *Attorney, Agent, or Firm*—Greenberg Traurig LLP

(57) ABSTRACT

A transfer switch configured particularly for use with traffic signal controllers, to enable a traffic signal controller to be powered by a portable electrical generator, when utility line power is unavailable. A housing, configured to be mounted either on the surface of a traffic signal controller cabinet, or recessed into an opening of the cabinet, so as to be flush to the surface thereof, is provided. The housing is configured to be substantially weatherproof without requiring the use of gaskets.

1 Claim, 44 Drawing Sheets

U.S. PATENT DOCUMENTS

| | | | | |
|---|---|---|---|---|
| 4,504,807 | A | 3/1985 | Nar | |
| 4,665,284 | A | 5/1987 | Guinan | |
| 4,672,227 | A | 6/1987 | Lagree et al. | |
| 4,716,496 | A | 12/1987 | Fritsch | |
| 4,760,226 | A | 7/1988 | Fasano | |
| D305,327 | S | 1/1990 | Newmark et al. | |
| 5,081,367 | A | 1/1992 | Smith et al. | |
| 5,164,694 | A | 11/1992 | DeVault et al. | |
| D332,088 | S | 12/1992 | Nimpoeno et al. | |
| 5,208,584 | A | 5/1993 | Kaye et al. | |
| 5,393,942 | A | 2/1995 | Reiner et al. | |
| 5,397,868 | A | 3/1995 | Smith et al. | |
| 5,486,664 | A | 1/1996 | Lamp et al. | |
| 5,581,133 | A | 12/1996 | Smith et al. | |
| 5,612,596 | A | 3/1997 | Wiese | |
| 5,659,305 | A | 8/1997 | Rains et al. | |
| D391,225 | S | 2/1998 | Wray | |
| D391,233 | S | 2/1998 | Sitler | |
| 5,898,389 | A | 4/1999 | Deese et al. | |
| 5,929,405 | A | 7/1999 | Wehrli, III et al. | |
| D416,232 | S | 11/1999 | Einck | |
| 6,002,579 | A | 12/1999 | Drexler et al. | |
| 6,043,439 | A | 3/2000 | Crooks et al. | |
| 6,094,130 | A | 7/2000 | Uischner et al. | |
| 6,100,604 | A | 8/2000 | Morroni et al. | |
| 6,121,897 | A | 9/2000 | Flegel | |
| 6,163,449 | A | 12/2000 | Flegel | |
| 6,227,890 | B1 | 5/2001 | Roper et al. | |
| 6,320,143 | B1 | 11/2001 | Greer | |
| 6,329,907 | B1 | 12/2001 | Uischner et al. | |
| 6,365,990 | B2 | 4/2002 | Flegel | |
| 6,437,269 | B1 * | 8/2002 | Rakus | 200/400 |
| 6,504,268 | B1 | 1/2003 | Flegel | |
| 6,534,735 | B1 | 3/2003 | Czarnecki | |
| 6,570,269 | B2 | 5/2003 | McMillan et al. | |
| 6,624,534 | B1 | 9/2003 | Flegel | |
| 6,862,596 | B2 | 3/2005 | Schnackenberg | |
| 6,927,349 | B1 | 8/2005 | Flegel et al. | |
| 7,115,830 | B1 * | 10/2006 | Weister et al. | 200/400 |

* cited by examiner 402
418
408
432
416
414
430
444

402
416
408
402
408
444
442

418
430
402
416
432
414
430

GENTRAN FLUSH TRANSFER SW.
450
IN LINE CONNECTORS
422
SLIDING INTERLOCK
424
422
GEN BRKR ON
UTIL BRKR ON
BLACK TO LOAD
MALE GEN INLET
420
WIRING HOLE IN BACK OF BOX
Red UTILITY Feed
WHITE TO NEUTRAL ASSY
Green GROUND
400

450
LEAD
EXTERNAL PILOT LIGHT
LEADS TO TRANSFER SW.
GENTRAN FLUSH TRANSFER SW
400
TRAFFIC SIGNAL CONTROL BOX

TRAFFIC SIGNAL TRANSFER SWITCH WITH INTERLOCK CONSTRUCTIONS

This application is a continuation-in-part of, and claims priority of the filing date of U.S. Ser. No. 11/157,753, filed 21 Jun. 2005, now U.S. Pat. No. 7,250,875, the complete disclosure of which is hereby expressly incorporated herein.

BACKGROUND OF THE DISCLOSURE

1. Field of the Invention

The present invention relates in general to transfer switches configured for use with portable electrical power generation devices, for powering traffic signals and the like, during periods of unavailability of utility line power.

2. Background

When the utility line power to an electrically powered and controlled traffic signal fails, it is imperative to arrange for an alternative power supply as quickly as possible, so that the traffic signal can resume operation. Otherwise, police officers typically must man the intersection where the non-functioning traffic signal is located, or else the motoring and pedestrian public is placed in danger from traffic through an uncontrolled intersection. Using police officers or other personnel not only is an inefficient use of manpower, but also can be dangerous to the individuals manning the intersection, as they typically must position themselves in the midst of traffic in order to be seen, to provide traffic control guidance.

Usually, the method of supplying auxiliary power comprises the placement of a small portable generator, usually powered by a gasoline internal combustion engine, next to the traffic signal control pedestal, and electrically connecting the power output connections of the generator to the power input connections of the traffic signal control pedestal.

However, simply breaking the hardwire connection between the traffic signal controller and the utility line, and making a hardwire connection directly between the generator output and the traffic signal controller input, is a time consuming, inefficient and inelegant solution. One cannot splice in the generator input without disconnecting the utility line, as failure to do so could result in the accidental driving of current back up the utility line, which could, in turn, result in utility equipment damage as well as grave personal injury.

SUMMARY OF THE INVENTION

The invention includes, in part, a transfer switch, operably configured to be connected to a portable electrical power generator, a traffic signal controller and a utility electrical power source, for enabling repeated switching between the portable electrical power generator and the utility electrical power source to provide electrical power to the traffic signal controller. A housing is provided, having a cavity therewithin and at least a first opening thereto. Transfer switch circuitry is disposed in the cavity in the housing. The transfer switch circuitry includes a power inlet for receiving the power outlet connector of a portable electrical power generator; a switching mechanism for reciprocably switching between at least a first position, enabling power to be supplied from the portable electrical power generator to the traffic signal controller, and a second position, enabling power to be supplied from the utility electrical power source to the traffic signal controller; a first electrical input connection, associated with the switching mechanism, and operably configured to be connected to a utility line power supply; a second electrical input connection, associated with the switching mechanism, and operably connected to the power inlet, and at least one electrical output connection, associated with the switching mechanism, and operably configured to be connected to a traffic signal controller; and an interlock device, operably associated with the switching mechanism, for preventing the switching mechanism from being positioned so as to enable power from both the portable electrical power generator and the utility electrical power source from being supplied to the traffic signal controller.

The housing may further comprise at least one pivotable cover for protecting the cavity from intrusion by undesired materials. The housing may be operably configured to be mounted to an exterior surface of a cabinet of a traffic signal controller. The traffic signal transfer switch may further comprise a face plate, disposed in the at least first opening, for enclosing transfer switch circuitry within the housing. The cover may further comprise a cord access opening in an outwardly-facing panel of the cover; and a movable cord access door mounted on an inside surface of the outwardly-facing panel of the cover, so as to be movable between a position covering the cord access opening, and a position exposing the cord access opening.

The switching mechanism may further comprise at least a first circuit breaker electrically connected between the first electrical input connection and the at least one electrical output connection; and at least a second circuit breaker electrically connected between the second electrical input connection and the at least one electrical output connection.

The traffic signal transfer switch may further comprise an indicator, operably connected to the switching mechanism, and operably configured to provide an indication when utility line power is available.

An indicator may be operably connected to the at least first circuit breaker, to indicate when utility line power is available. The indicator may be a light. The light may be mounted on an exterior surface of the traffic signal controller.

The housing may be operably configured to be mounted within a suitably configured recess in a cabinet for a traffic signal controller. The housing may comprise a top wall, a bottom wall, two opposed side walls and a rear wall, and a front opening.

The housing may further comprise a plurality of run-off channels extending along the top wall, and two opposed side walls, between the front opening and the at least one mounting flange. Each of the run-off channels may have a J-shaped cross-sectional configuration.

The at least one pivotable cover may comprise a front cover panel, hingedly mounted to the at least one mounting flange, the front cover panel being pivotable between at least a first, upward open position, and a second, downward closed position; and a plurality of side flanges emanating rearwardly from at least top and side edges of the front cover panel, when the front cover panel is in its second, downward closed position. The side flanges may be configured to extend over the run-off channels, when the front cover panel is in its closed position.

The switching mechanism may comprise two first circuit breakers electrically connected between the first electrical input connection and the at least one electrical output connection; and two second circuit breakers electrically connected between the second electrical input connection and the at least one electrical output connection.

The transfer switch circuitry may further comprise a first electrical neutral connection, associated with the switching mechanism, and operably configured to be connected to a neutral connection of a utility line power supply; a second electrical neutral connection, associated with the switching mechanism, and operably configured to be connected to a neutral connection of the power inlet; and a third electrical neutral connection, associated with the switching mechanism and operably configured to be connected to a neutral electrical connection of a traffic signal controller.

The switching mechanism may further comprise a first neutral circuit breaker, connected to the first electrical neutral connection and the third electrical neutral connection; and a second neutral circuit breaker, connected to the second electrical neutral connection and the third electrical neutral connection.

The invention also includes, in part, a switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another. An elongated slider member, having a longitudinal axis and first and second end faces, is operably configured to slidably move between the handles. A rocker member is operably disposed to pivot about an axis disposed perpendicular to the longitudinal axis of the elongated slider member, the rocker member having two inner cam surfaces adjacent the pivot axis, two outer cam surfaces distal to the pivot axis, and two interference surfaces disposed between the respective inner and outer cam surfaces. The rocker member is operably configured so as to engage the respective handles, toward movement in cooperation with the slider member, so as to engage the handle of a breaker which is being moved from an "OFF" position to an "ON" position, and prevent its movement to a top dead center position, before a corresponding breaker has moved from its respective "ON" position to its respective "OFF" position.

BRIEF DESCRIPTION OF THE DRAWINGS

FIG. 52 is a front elevation of the face plate for the flush-mounted traffic signal transfer switch, according to the embodiment of FIG. 35.

DETAILED DESCRIPTION OF THE INVENTION

Figure 1:
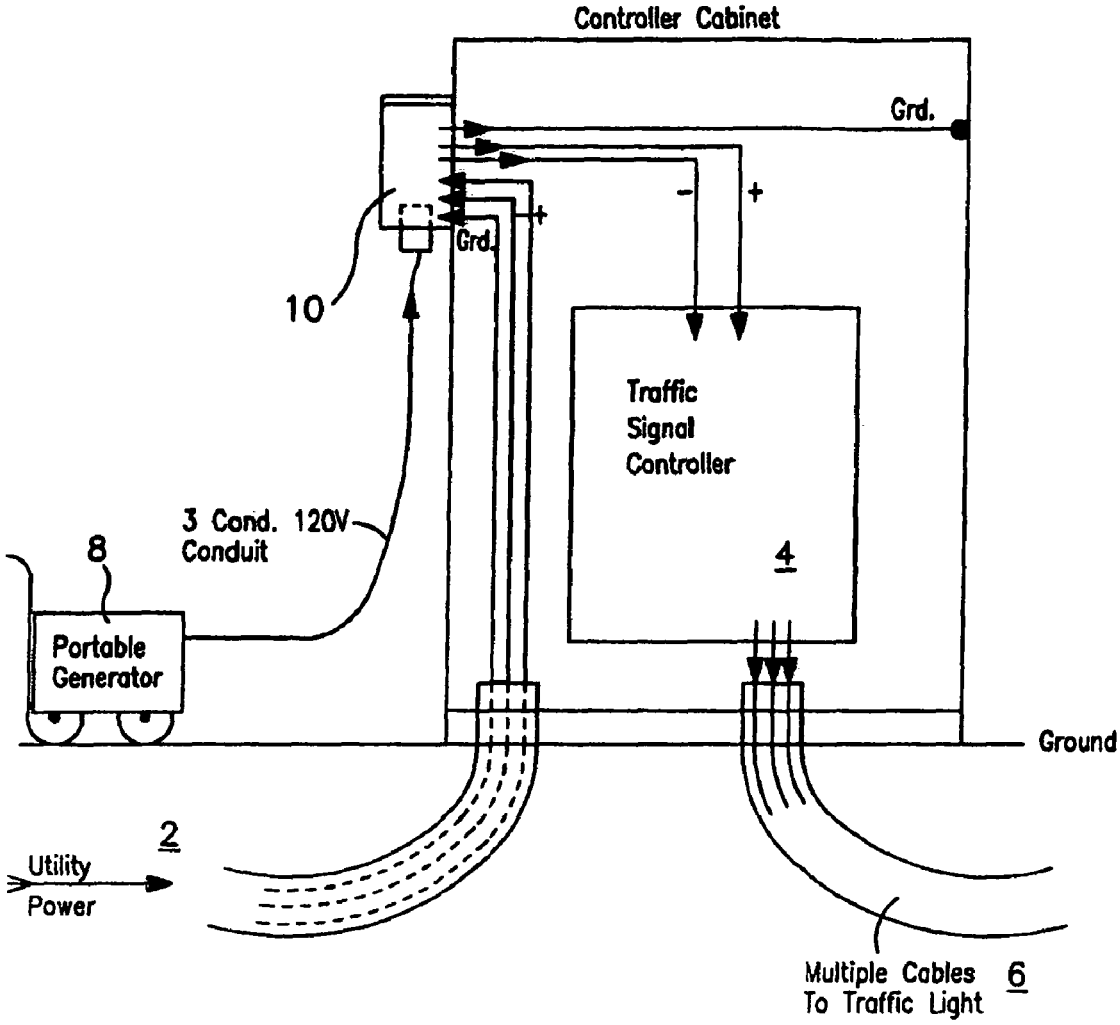
FIG. 1 is a simplified schematic illustration of the electrical connections between utility power, a traffic signal controller, a portable power generator and traffic signal transfer switch.

While this invention is susceptible of embodiment in many different forms, there are shown in the drawings and will herein be described in detail, several embodiments with the understanding that the present disclosure should be considered as an exemplification of the principles of the invention and is not intended to limit the invention to the embodiments so illustrated. Further, to the extend that any numerical values or other specifics of materials, etc., are provided herein, they are to be construed as exemplifications of the inventions herein, and the inventions are not to be considered as limited thereto.

FIG. 1 is a simplified schematic illustration of the electrical connections between utility power 2, a traffic signal controller 4 connected to one or more traffic signals 6 (not shown), a portable power generator 8 and a traffic signal transfer switch 10, in accordance with the present invention.

The present invention contemplates three different transfer switch circuitry configurations, and two different housing configurations. The three different circuitry configurations are: 1) single pole (FIG. 2); 2) double pole (FIG. 3); and 3) single pole with switched neutral (FIG. 4). The reasons for the different configurations are as follows. Most, but not all, traffic signal controllers at the present time, operate on 120 VAC, so a single pole transfer switch is adequate for most applications. Some municipalities and other applications may have a 120/240 VAC system, so a two-pole device is required. With respect to the single-pole, switched neutral transfer switch, it is believed by some that potentially dangerous "stray" currents may run through the neutral wire, during operation of the portable generator, so some municipal (or other) regulations require that the neutral wires be switched as well.

Figure 2:
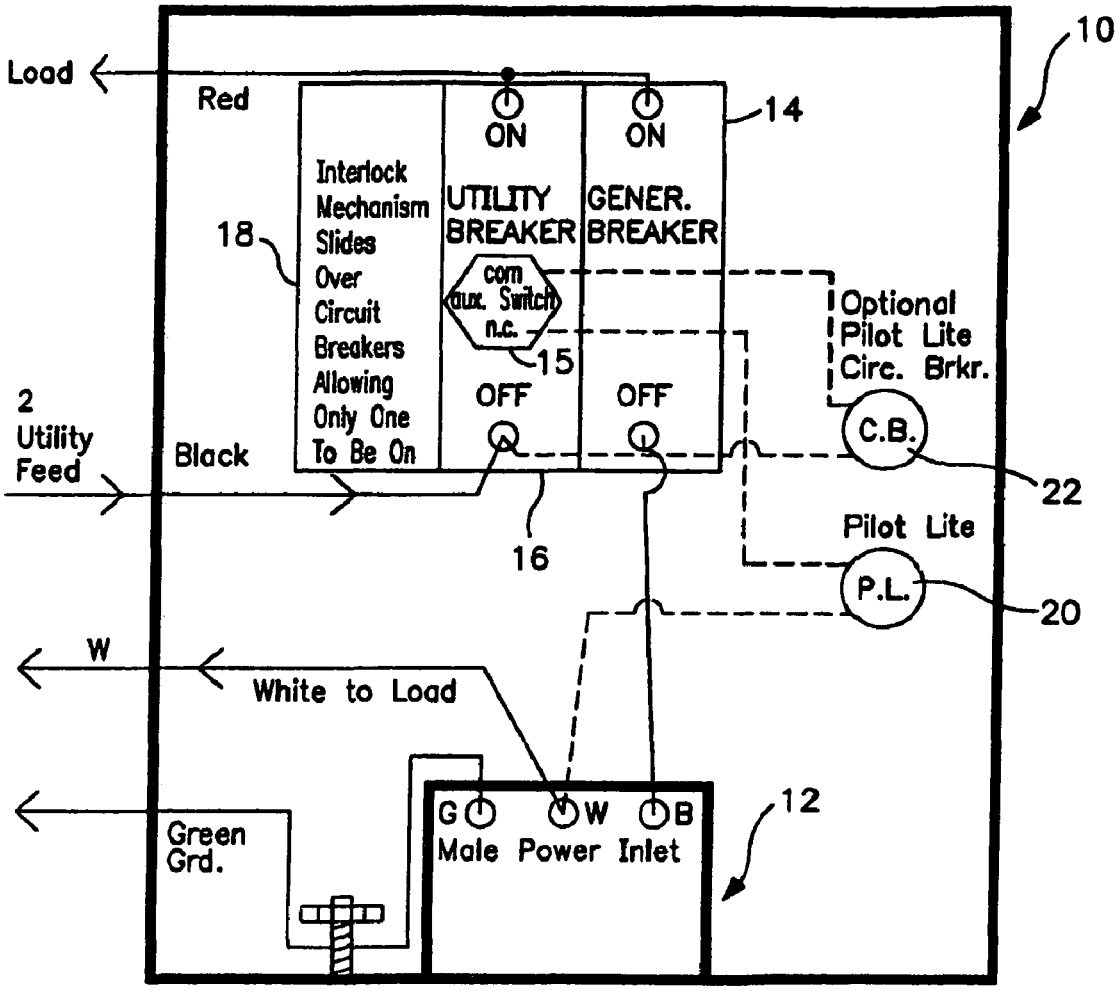
FIG. 2 is a schematic illustration of transfer switch circuitry according to an embodiment of the invention.

In the basic version of the transfer switch apparatus 2, see FIG. 2, traffic signal transfer switch 10 is electrically connected to the utility power feed, to ground, and to the load (the traffic signal controller). As would be readily perceived by one of ordinary skill in the art, having the present disclosure before them, this would be accomplished by gaining access to the utility power feed 2 (FIG. 1), and to the power inputs to the traffic signal controller 4, via a suitable access aperture either already provided (e.g., by conventional knock-outs), or cut into the side of the housing of the traffic signal controller.

Traffic signal transfer switch 10 will be provided with a weatherproof housing (as discussed in further detail hereinafter), in which is contained a male power inlet 12, having a suitable socket for receiving the power outlet cord of a portable generator 8 (FIG. 1). Transfer switch 10 also includes two break-before-make circuit breakers 14, 16 for the generator circuit and the utility power circuit, respectively. By way of example, and not to limit the invention thereto, the circuit breakers may be of the type manufactured by Carling Technologies, C-Series Circuit Breakers (without microswitch for breaker 14 and with microswitch for breaker 16). Representative model numbers for such breakers could be CA1-BO-24-620-121-KG, CA1-BO-24-630-121-KG, and CA1-BO-24-650-121-KG (for 20, 30 and 50 amp single pole breakers without auxiliary microswitches); CA2-BO-24-620-121-CG, CA2-BO-24-630-121-CG, and CA2-B024-650-121-CG (for 20, 30 and 50 amp 2 pole breakers without auxiliary microswitches), CA1-B2-24-620-121-KG, CA1-B2-24-630-121-KG and CA1-B2-24-650-121-KG (for 20, 30 and 50 amp single pole breakers with microswitches), and CA2-B2-24-620-121-CG, CA2-B2-24-630-121-CG and CA2-B2-24-650-121-CG (for 20, 30 and 50 amp 2 pole breakers with auxiliary microswitches), but the invention is in no way intended to be limited to these specific switches; any other suitable switches may be used. Lockout mechanism 18 is provided, which is configured (as shown hereinbelow) to slide back and forth over the switch handles of the respective circuit breakers, to ensure that at any given time, only one of the circuit breaker switch handles can be in its "ON" position. An interlock mechanism, in which the two breaker switch handles are mechanically connected so that their movements are coordinated, may alternatively be used, to prevent both switch handles from being in their respective "ON" positions simultaneously.

In addition, transfer switch 10 is provided with a "pilot light" 20 (and associated pilot light circuit breaker 22), which is connected to the utility power circuit in such a manner that whether the switch handle of circuit breaker 16 is in its "OFF" position, if there is a voltage of a minimum required value across the utility power circuit breaker 16, then pilot light 20 will be lit, indicating that the utility power circuit has been restored and is available, so that an operator, such as a police officer, or municipal or county employee can turn off the generator, shift the lockout device, and flip the utility power circuit breaker to "ON", to restore operation of the traffic signal controller to utility power. The generator 8 can then be disconnected from the transfer switch 10, and removed. Specifically, breaker 16 is provided with an auxiliary microswitch (used elsewhere for powering a light for a remote panel to indicate position of the breaker, depending upon how the microswitch is wired), in the form of a single-pole, double-throw (SPDT) switch 15 built into the circuit breaker, and operated in slave fashion by the main circuit breaker handle. When the utility circuit breaker 16 is flipped to "ON", then microswitch 15 opens, so that current to pilot light 20 is cut off. One of ordinary skill in the art of electrical circuit design may substitute circuit breakers from other manufacturers, which also provide optional microswitches, for those described hereinabove, without departing from the scope of the invention.

Figure 3:
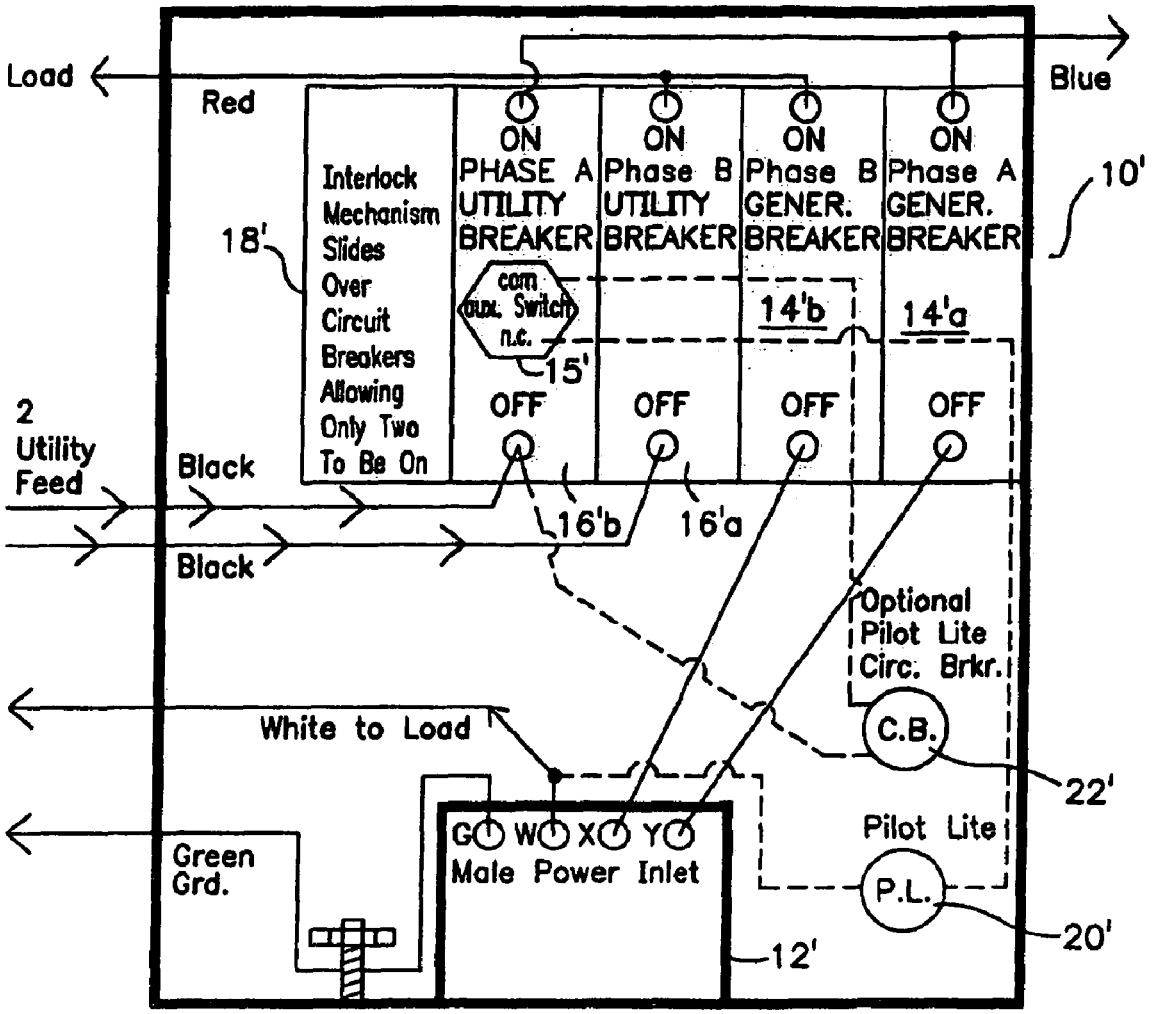
FIG. 3 is a schematic illustration of transfer switch circuitry according to another embodiment of the invention.
Figure 4:
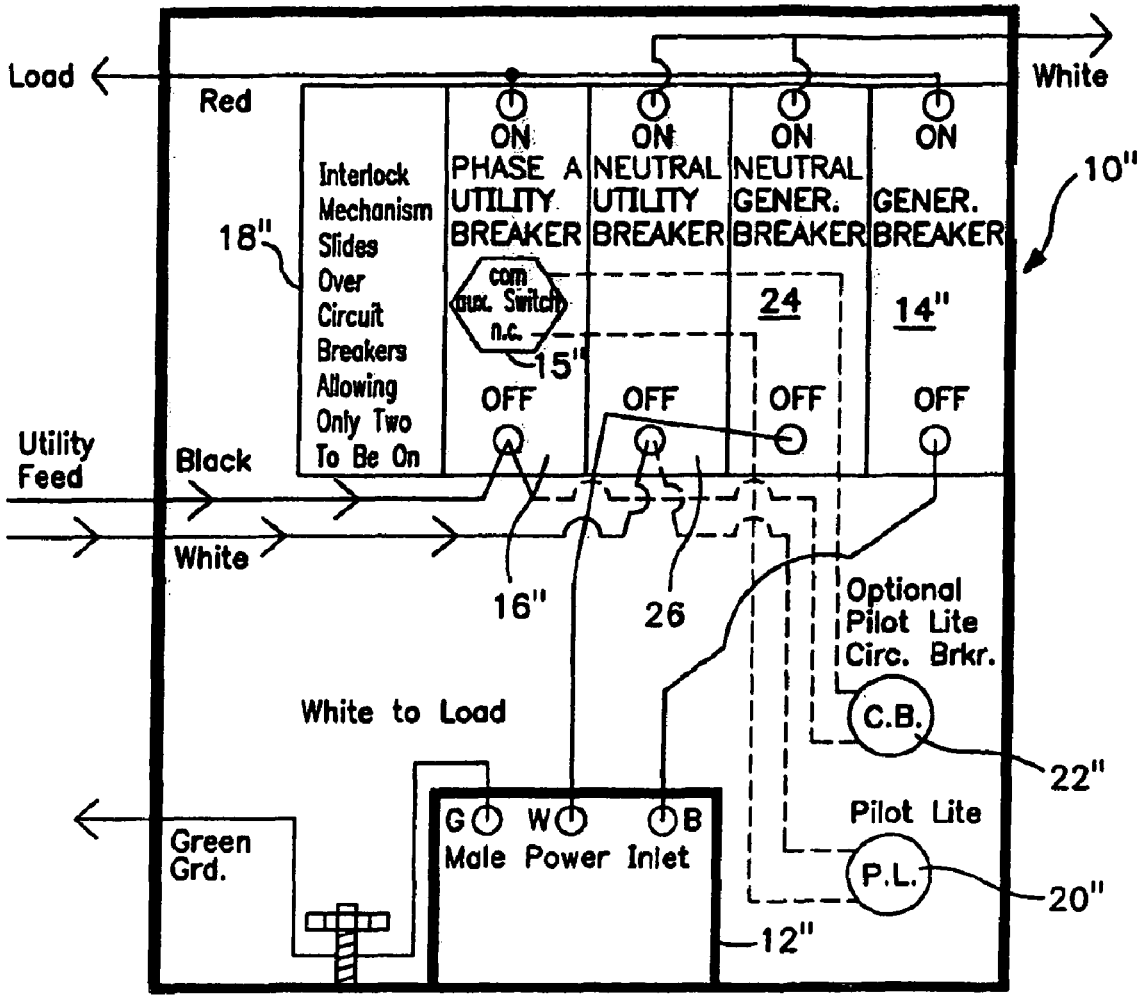
FIG. 4 is a schematic illustration of transfer switch circuitry according to another embodiment of the invention.

FIG. 3 is a schematic illustration of the circuitry of a two-pole traffic signal transfer switch. To the extent that two-pole traffic signal transfer switch 10' is provided with components having identical, similar or analogous structures and/or functions as that of single pole transfer switch 10, like reference numerals, augmented by a prime (') and, as necessary, letters, will be employed. The circuitry of transfer switch 10' differs from that of transfer switch 10 primarily in that two breakers (14'*a*, 14'*b* and 16'*a*, 16'*b*) are provided for each of the generator and utility power circuits, mostly for enabling larger voltage loads to be supplied, e.g., up to 250 volts for the two-breaker transfer switch 10', versus up to 125 volts for the single pole transfer switch 10. Alternatively, breakers 14'*a*, 14'*b* and 16'*a*, 16'*b* may be formed by two two-pole breakers, wherein one side of one of the two-pole breakers is provided with a microswitch, such as may be commercially obtained from Carling Technologies, as mentioned above. Lockout mechanism 18' will be provided so as to cover the (usually interconnected) switch handles of either circuit breakers 14'*a* and 14'*b*, or 16'*a* and 16'*b*. Pilot light 20' and associated circuit breaker 22' will be connected to one or the other of circuit breakers 16'*a*, 16'*b* (having a microswitch 15'), again, to indicate when there is power available in the utility power circuit, when the utility power circuit breakers are in their respective "OFF" positions.

FIG. 4 is a schematic illustration of the circuitry of a single-pole switched neutral traffic signal transfer switch. To the extent that two-pole traffic signal transfer switch 10" is provided with components having identical, similar or analogous structures and/or functions as that of single pole transfer switch 10, like reference numerals, augmented by a double prime (") and, as necessary, letters, will be employed. Transfer switch 10" differs from the single-pole transfer switch 10, in that in addition to generator circuit breaker 14" and utility circuit breaker 16", neutral generator breaker 24 and neutral utility breaker 26 are provided.

Figure 5:
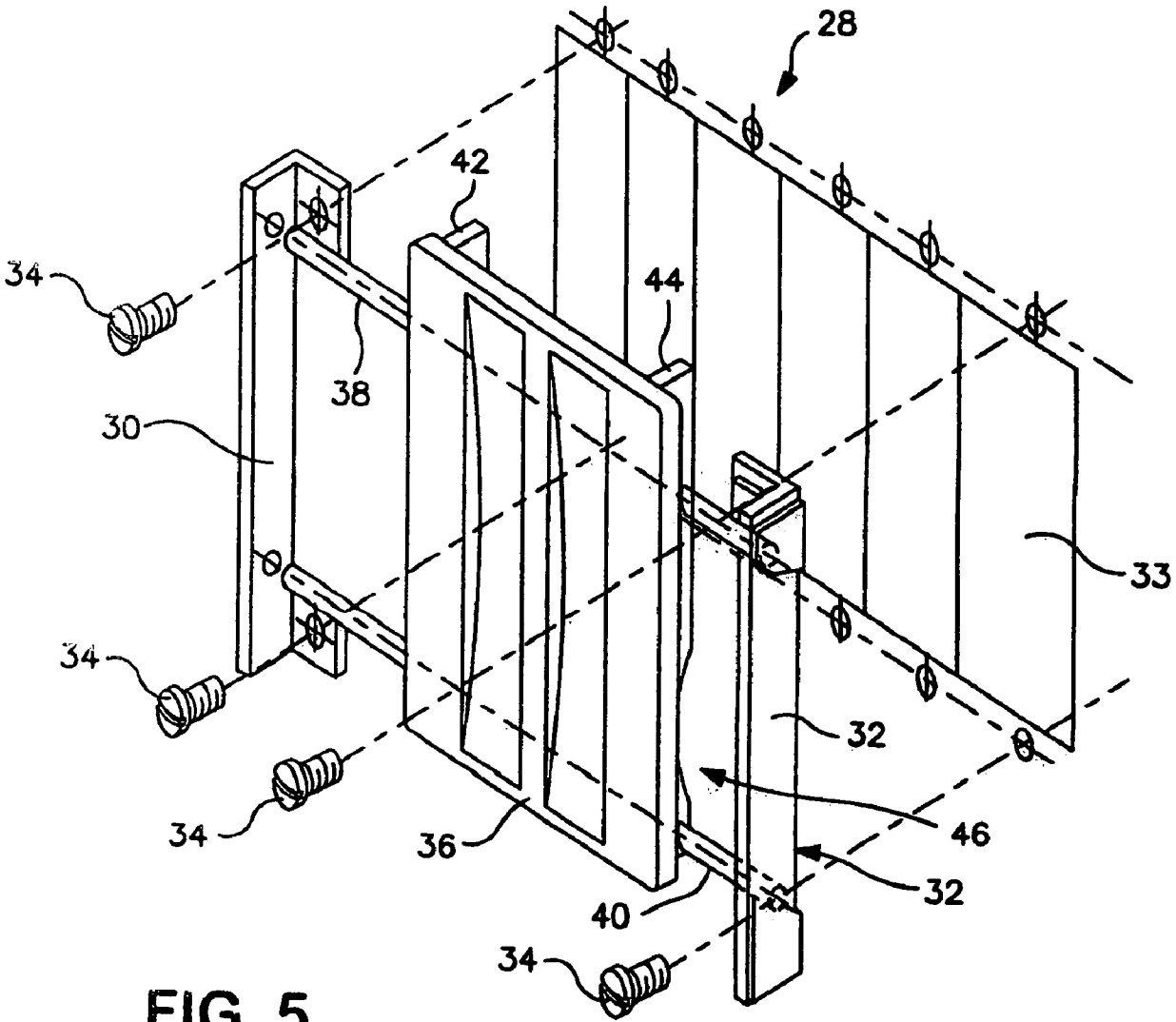
FIG. 5 is an exploded perspective view of a lockout device for use with the transfer switches of the present invention.
Figure 7:
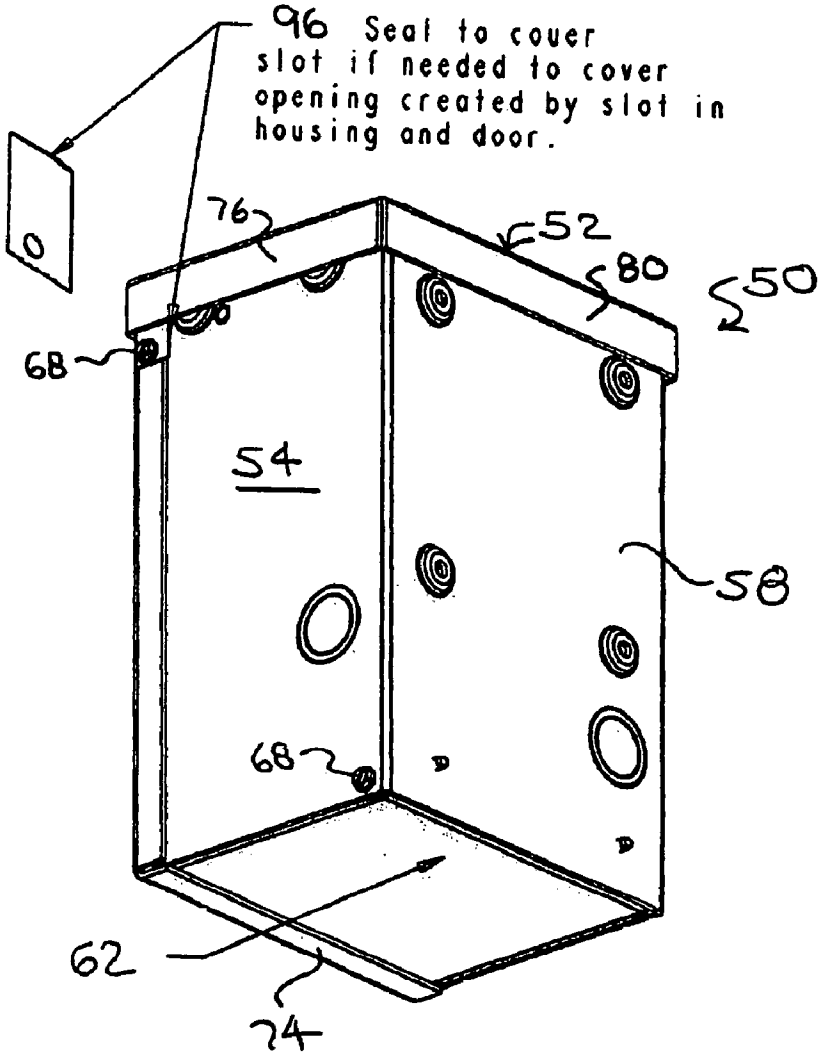
FIG. 7 is a bottom, rear, perspective view of the surface-mounted transfer switch, in a closed configuration.
Figure 6:
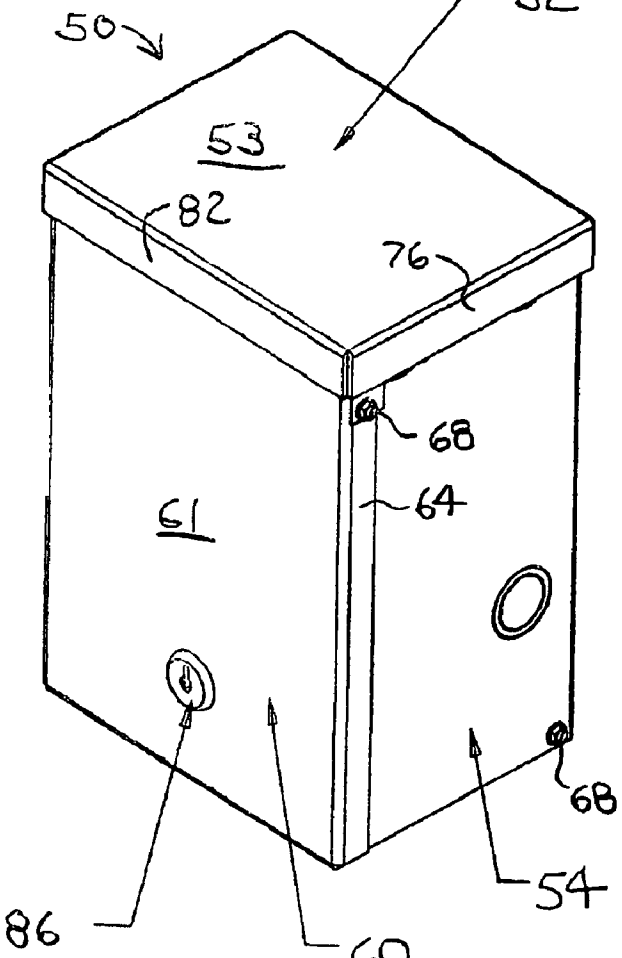
FIG. 6 is a top, front, perspective view of a surface-mounted traffic signal transfer switch according to an embodiment of the invention, in a closed orientation.
Figure 9:
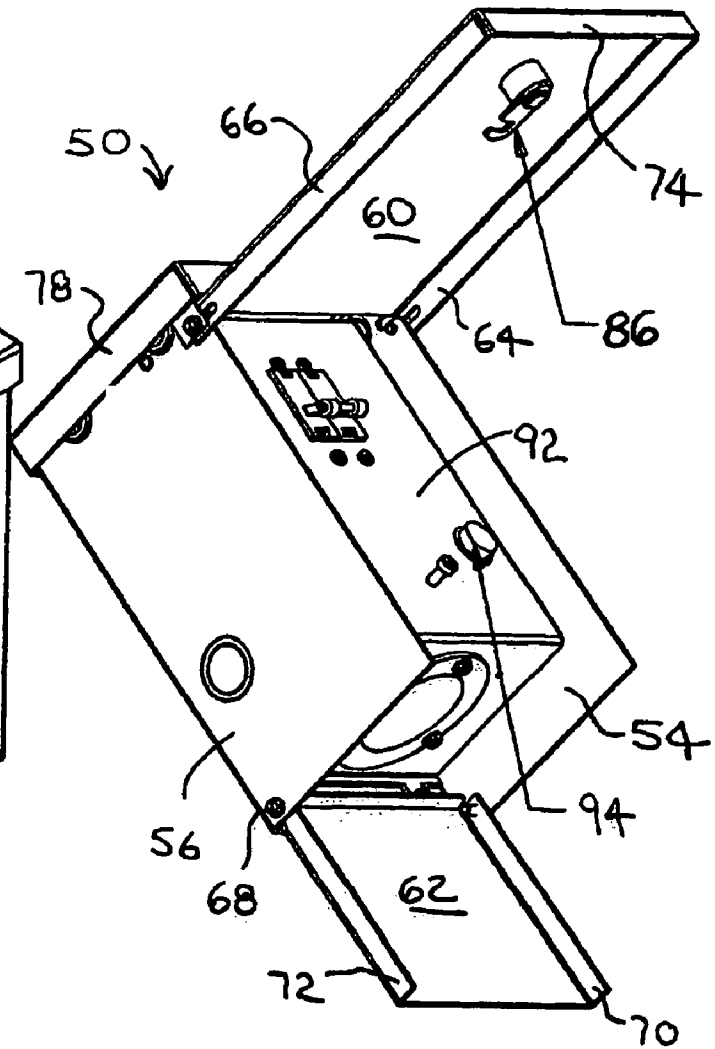
FIG. 9 is a bottom, front, perspective view of the surface-mounted traffic signal transfer switch, in an open configuration.
Figure 8:
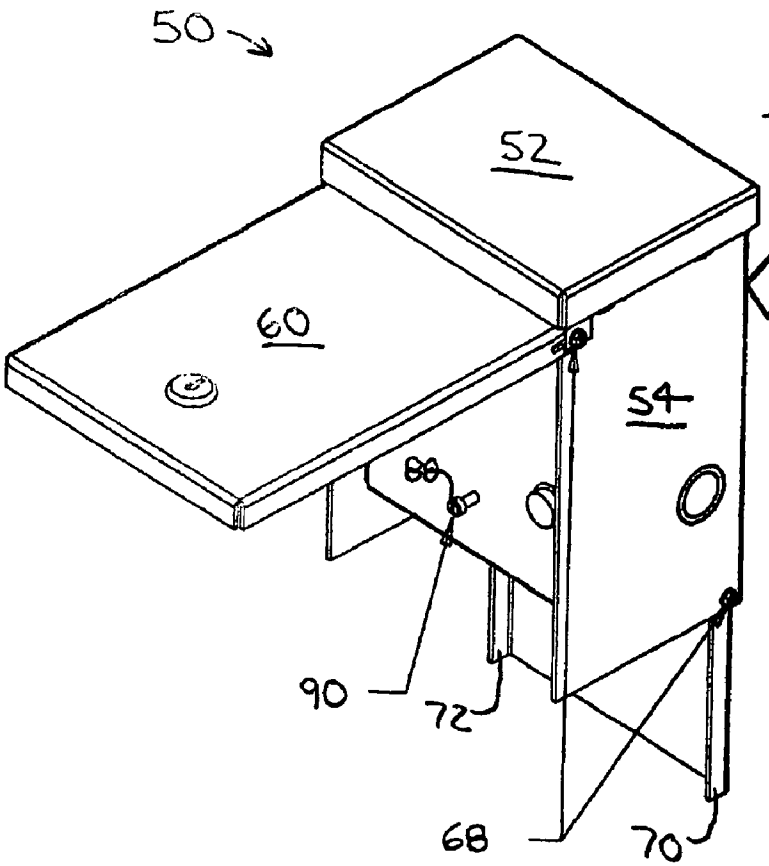
FIG. 8 is a top, front, perspective view of the surface-mounted traffic signal transfer switch, in an open configuration.

FIG. 5 is a perspective exploded view of an interlock (lockout) device 28, which may be employed with any of transfer switches 10, 10' or 10". Lockout device 28, which may be of the type commercially available from Carlingswitch, Inc. of Plainville, Conn., incorporates two end caps 30, 32, which are attached (e.g., via machine screws 34) preferably to the front surface 33 of the inner faceplate of the transfer switch (details of the transfer switch housings to be discussed hereinafter), or to the faces of the circuit breakers themselves. Handle lockout 36 is configured to be slidingly inserted onto pins 38, 40. Typical assembly would be to mount one end cap 30 to the transfer switch, then insert pins 38, 40 into cap 30. Lockout 36 is then slid onto pins 38, 40. Finally, remaining end cap 32 is fitted to the free ends of pins 38, 40, and fastened to the transfer switch face. Lockout 36 includes two webs 42, 44, extending normal to the faceplate, each of which has a notch 46, configured for providing clearance for accommodating the switch handle(s) of the generator or utility circuit breakers, when in their "OFF" (typically down) positions. The foregoing description represents one particular structure for a lockout device for side-by-side breaker switches. Other lockout structures may be employed, without departing from the scope of the present invention.

FIGS. 6-9 illustrate views of the outside of a housing for a transfer switch unit, according to the present invention. In an embodiment of the invention, housing 50 includes top 52 (with top face 53), sides 54 and 56, back 58, hinged front 60 (with front surface 61) and hinged bottom 62. Preferably, housing 50 may be fabricated sheet metal (e.g., rust-resistant steel or aluminum) which has been suitably cut or stamped, bent and molded, as desired. In an embodiment, top 52 may be formed from a separate piece of material, apart from sides 54 and 56, and back 58, which may be formed from a single piece of metal, and suitably attached thereto, by any suitable method, such as welding.

Front 60 includes two side flanges 64, 66 which cover the front edges of sides 54, 56, when front 60 is in its down/closed position. Front 60 is pivotably connected to sides 54, 56, via, e.g., rivets 68 passing through side flanges 64, 66, and sides 54, 56, respectively. Bottom 62 includes two side flanges 70, 72, which fit inside the bottom edges of sides 54, 56, when bottom 62 is in the up/closed position. Front 60 does not simply pivot about rivets 68. Rather, rivets 68 pass through elongated slots (see FIGS. 19, 20). Movement of front 60 first involves unlocking lock 86 (discussed below), then sliding front 60 downwardly relative to sides 54, 56, and then pivoting front 60 upwardly relative to housing 50. Bottom 62 is pivotably attached to sides 54, 56 also by suitable fasteners, e.g., rivets 68. Front 60 also includes a bottom flange 74, which covers the leading edge of bottom 62, when bottom 62 is in its up/closed position. Top 52 includes downwardly extending flanges 76, 78, 80 and 82, which cover (or shield) the upper edges of sides 54 and 56, back 58 and front 60. By providing coverage for otherwise exposed edges, as described hereinabove, housing 50 is constructed to be substantially rainproof, for ordinary weather conditions that may be encountered. If necessary, where rivets 68 are used to pivotably mount front 60, to cover slots 102, 104, additional protection in the form of rectangular seals 96 (preferably fabricated from a suitable plastic material, such as polycarbonate film) may be provided.

Housing 50 includes for security purposes key-operated lock 84, which includes hook member 86, which engages behind flange 88 of bolt 90, in faceplate 92. The breaker switches shown positioned in faceplate 92 (e.g., FIG. 9) are shown solely by way of example, and not intended to limit the scope of the present invention. Faceplate 92 may also include a pilot light 94 (as described above), which may be physically positioned at any suitable location on faceplate 92. Alternatively, pilot light 94 may be positioned on sides 54 or 56, or in top 52 (if suitable gasketing is provided to create a weatherproof interface between the pilot light and the surface of the respective side or top).

Figures 10, 11, 12, 13, 14:
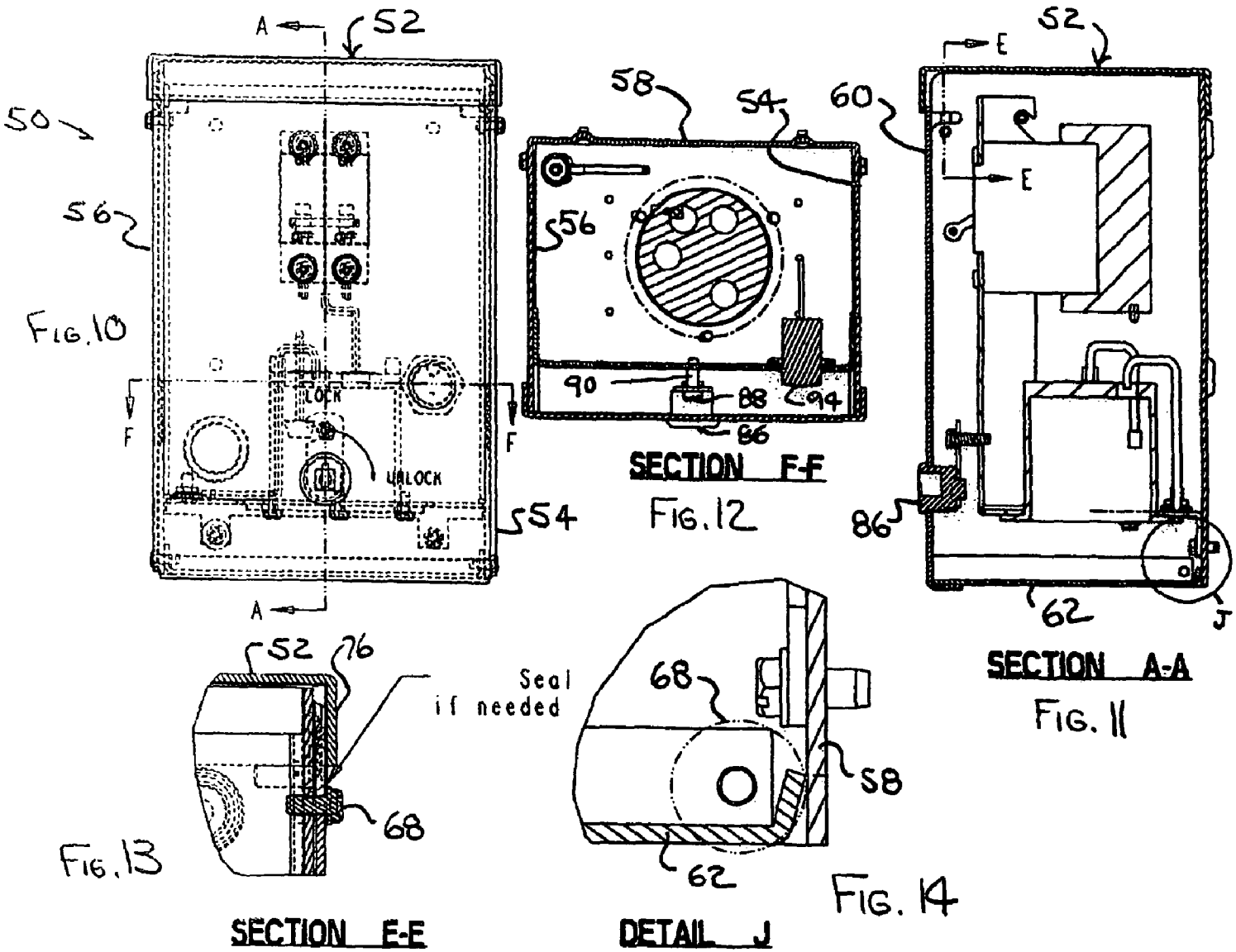
FIG. 10 is a front elevation of the surface-mounted traffic signal transfer switch, in closed configuration.
FIG. 11 is a side elevation, in section, taken along line A-A of FIG. 10.
FIG. 12 is a top elevation, in section, taken along line F-F of FIG. 10.
FIG. 13 is a fragmentary front elevation, in section, taken along line E-E of FIG. 11.
FIG. 14 is an enlarged detail of the housing of the surface-mounted traffic signal transfer switch, of detail J, shown circled in FIG. 11.

FIG. 10 is a front elevation of the surface-mounted traffic signal transfer switch, in closed configuration. FIG. 11 is a side elevation, in section, taken along line A-A of FIG. 10. FIG. 12 is a top elevation, in section, taken along line F-F of FIG. 10. FIG. 13 is a fragmentary front elevation, in section, taken along line E-E of FIG. 11. FIG. 14. is an enlarged detail of the housing of the surface-mounted traffic signal transfer switch, of detail J, shown circled in FIG. 11. Any internal structures illustrated therein are shown strictly by way of example, and the present invention is not intended to be limited to any specific combination or positioning of the internal electrical components shown in these figures.

Figure 15:
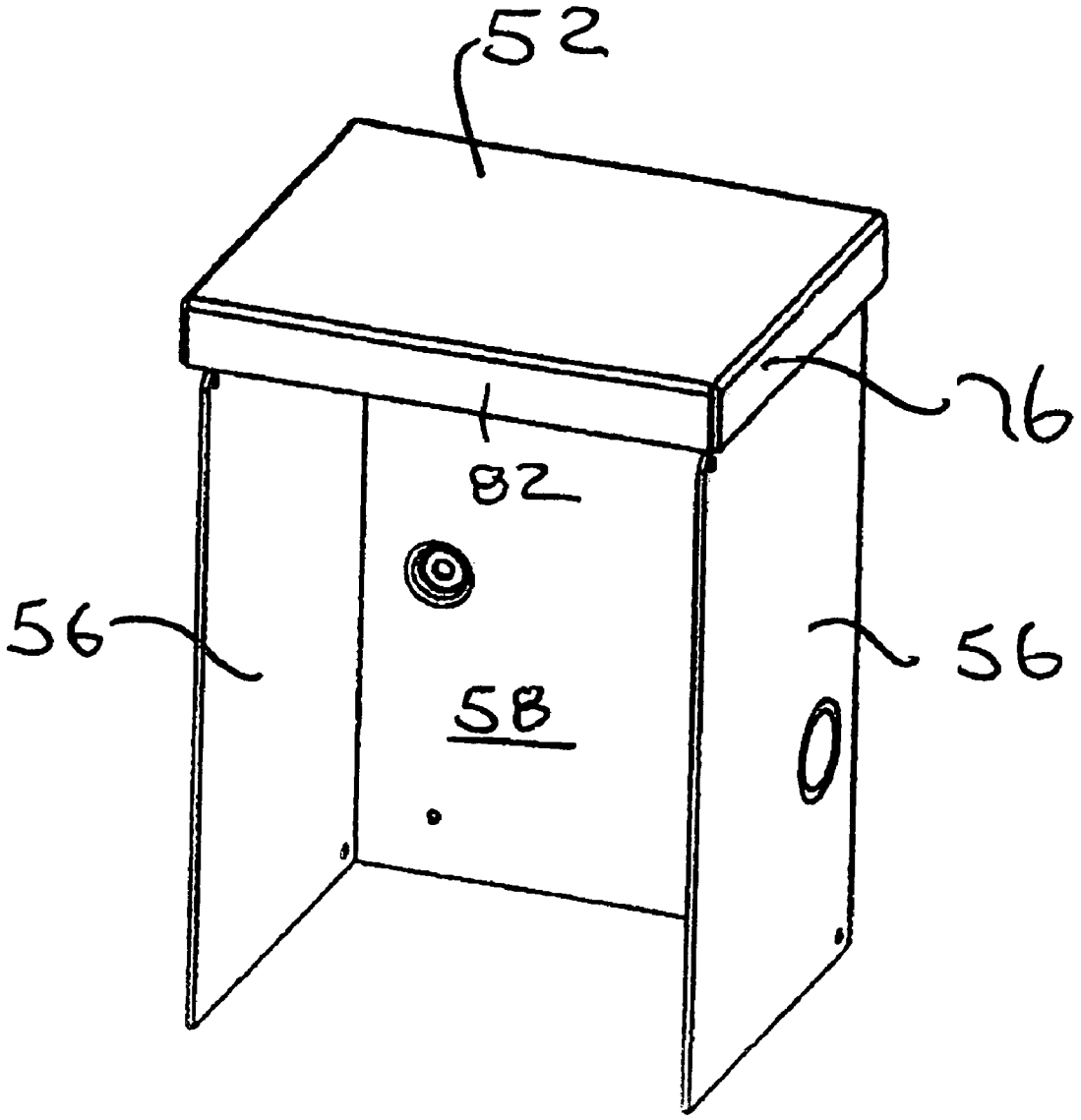
FIG. 15 is a top, front, perspective view of the top, sides and back portions of the housing for the surface-mounted traffic signal transfer switch.
Figure 16:
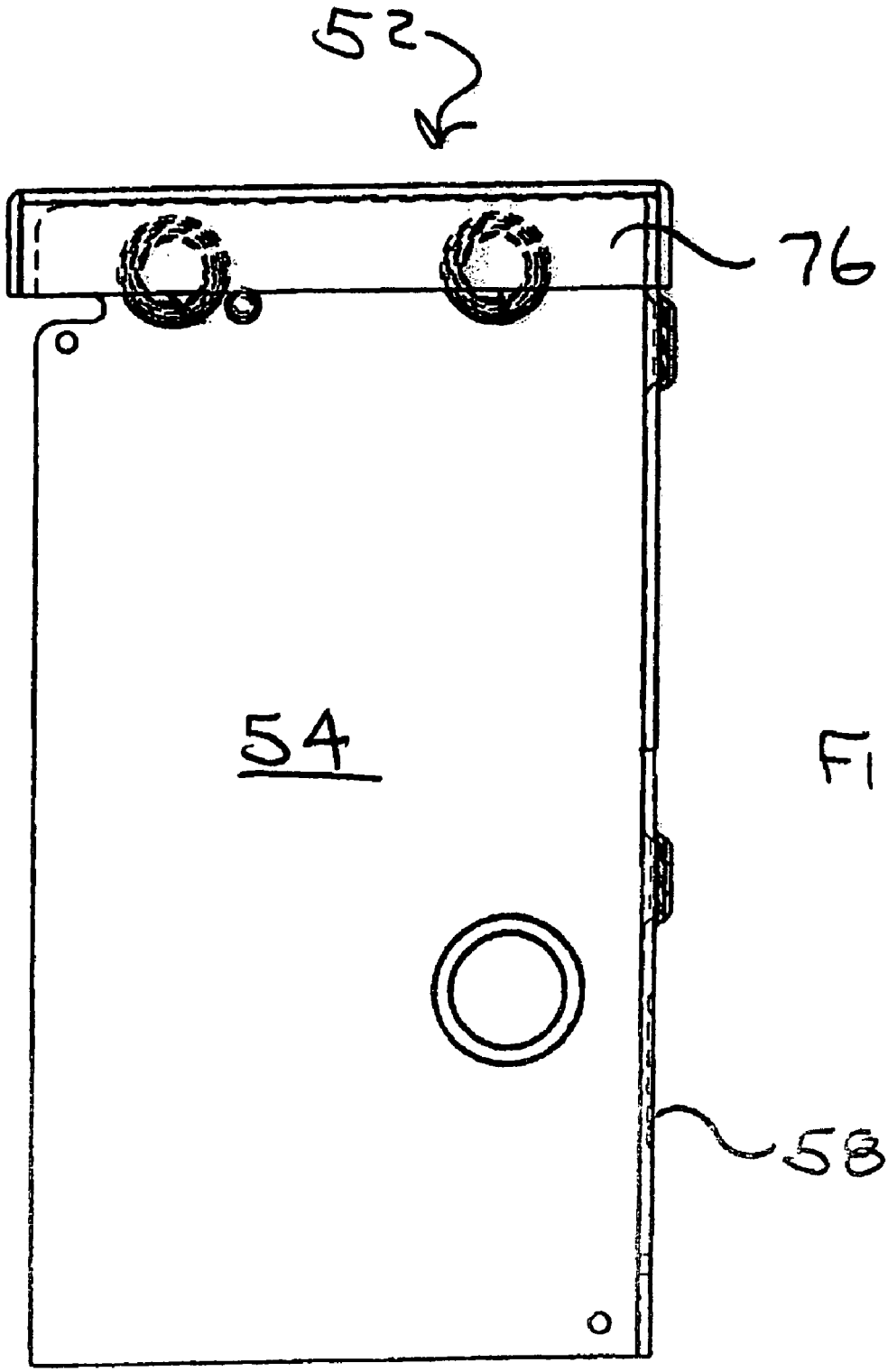
FIG. 16 is a side elevation of the top, side and back portions of the housing for the surface-mounted traffic signal transfer switch.

FIG. 15 is a top, front, perspective view of the top 52, sides 56 and 56 and back 58 portions of the housing for the surface-mounted traffic signal transfer switch. FIG. 16 is a side elevation thereof.

Figure 18:
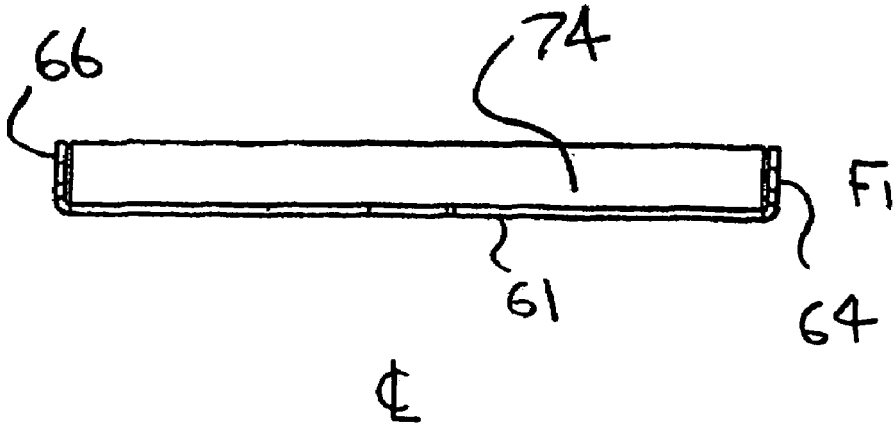
FIG. 18 is a top plan view of the front cover of the housing for the surface-mounted traffic signal transfer switch.
Figure 17:
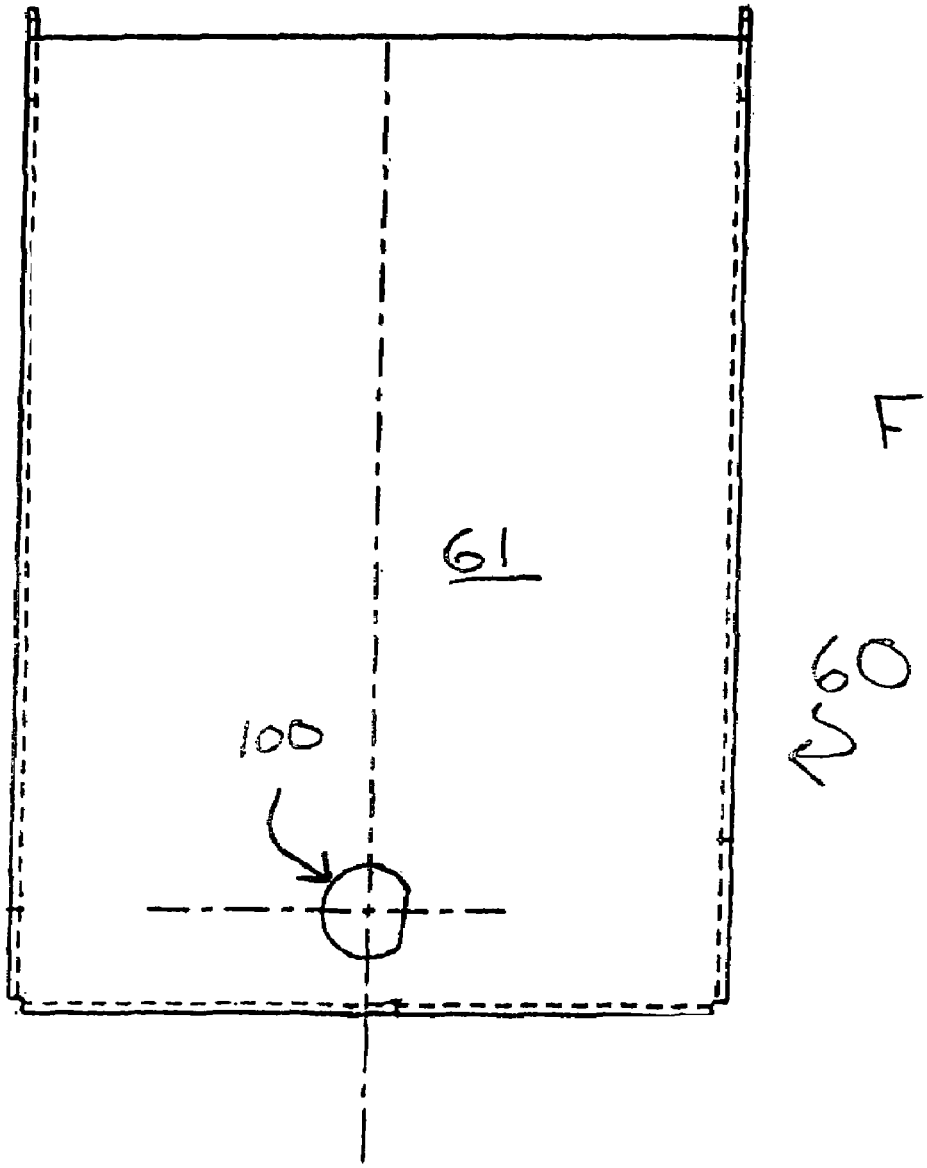
FIG. 17 is a front elevation of the front cover for the housing for the surface-mounted traffic signal transfer switch.
Figure 19:
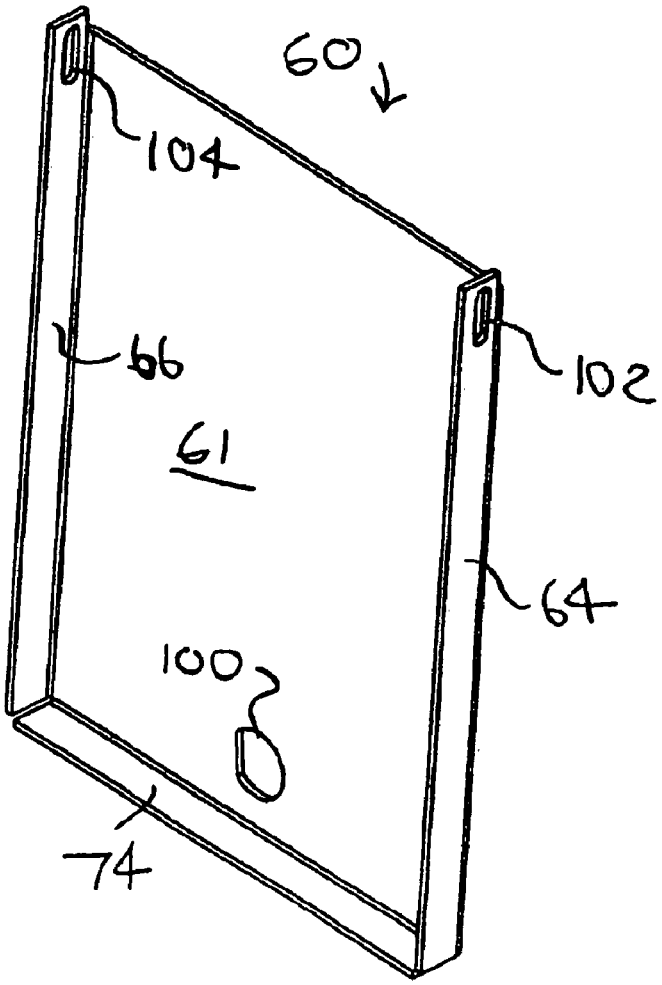
FIG. 19 is an inside perspective view of the front cover of the housing for the surface-mounted traffic signal transfer switch.
Figure 20:
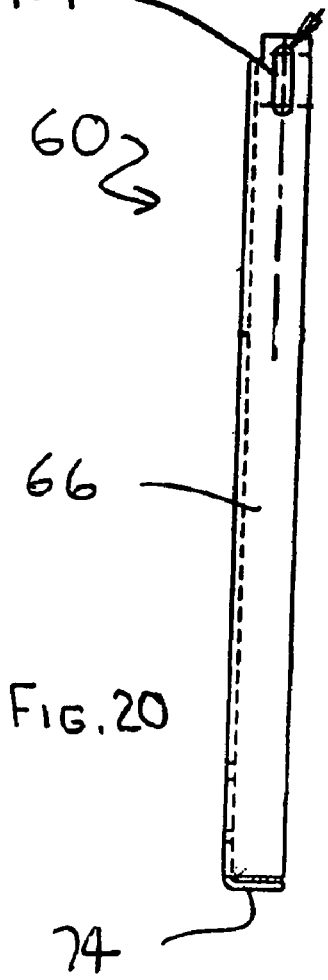
FIG. 20 is a side elevation of the front cover of the housing for the surface-mounted traffic signal transfer switch.

FIG. 17 is a front elevation of the front cover for the housing for the surface-mounted traffic signal transfer switch, showing, in particular, opening 100 for receiving lock 86. FIG. 18 is a top plan view thereof. FIG. 19 is an inside perspective view thereof, showing slots 102, 104 (through which rivets 68 pass), which permit cover 61 to slide vertically, as well as pivot, relative to the sides, top and back of the housing 50. FIG. 20 is a side elevation thereof.

Figure 21:
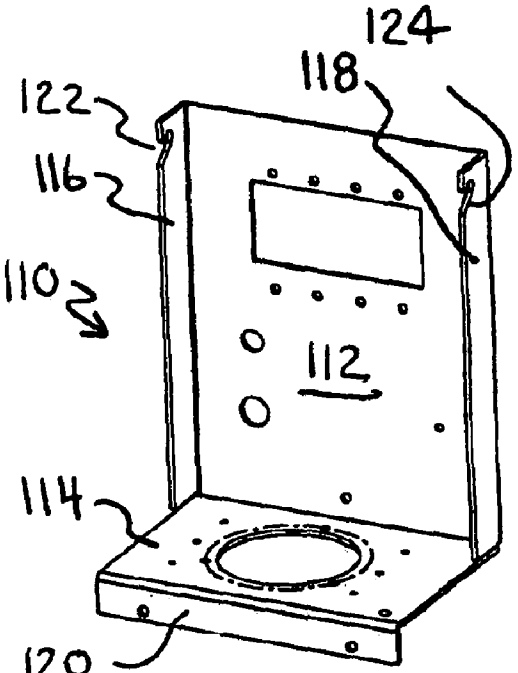
FIG. 21 is a perspective view of the face plate for mounting the electrical components for the surface-mounted transfer switch.
Figure 24:
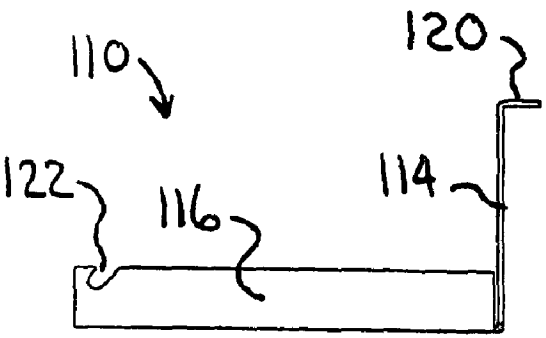
FIG. 24 is a side elevation of the face plate.
Figure 25:
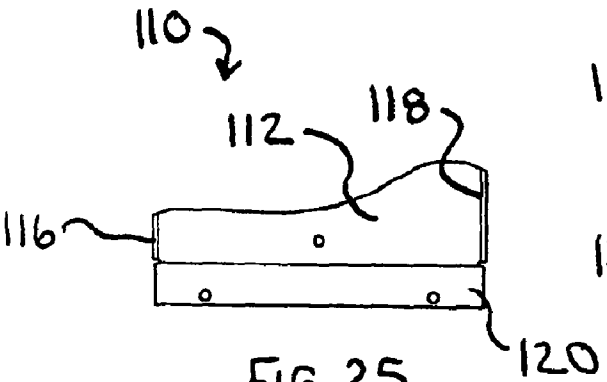
FIG. 25 is a fragmentary rear view of the face plate.
Figure 23:
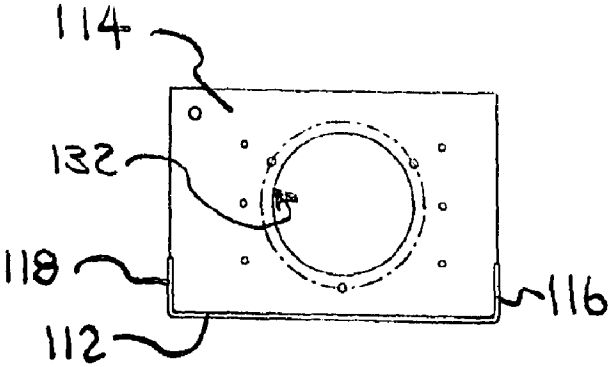
FIG. 23 is a top plan view of the face plate.
Figure 22:
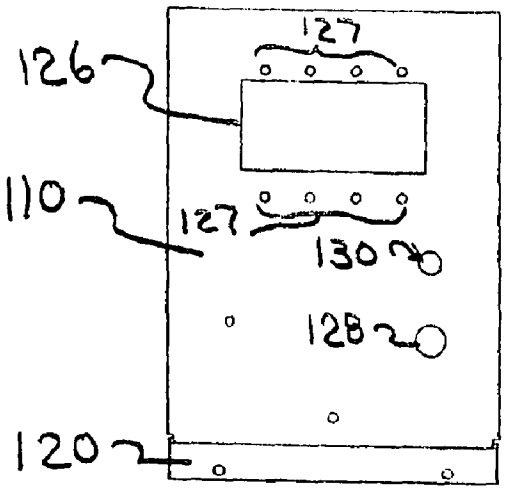
FIG. 22 is a front elevation of the face plate.
Figure 26:
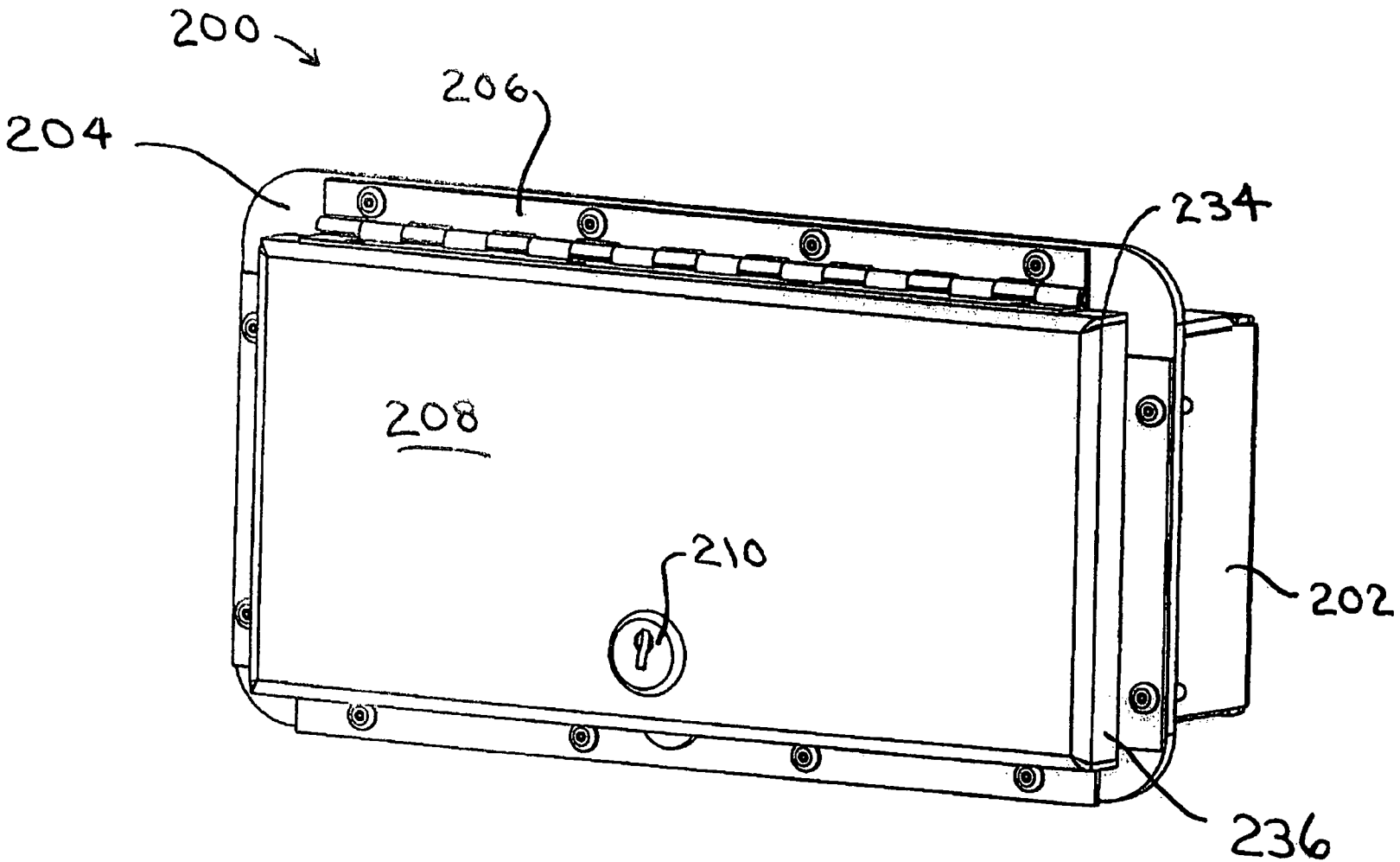
FIG. 26 is a perspective view of a flush-mounted traffic signal transfer switch according to an alternative embodiment of the invention, shown in a closed configuration.
Figure 27:
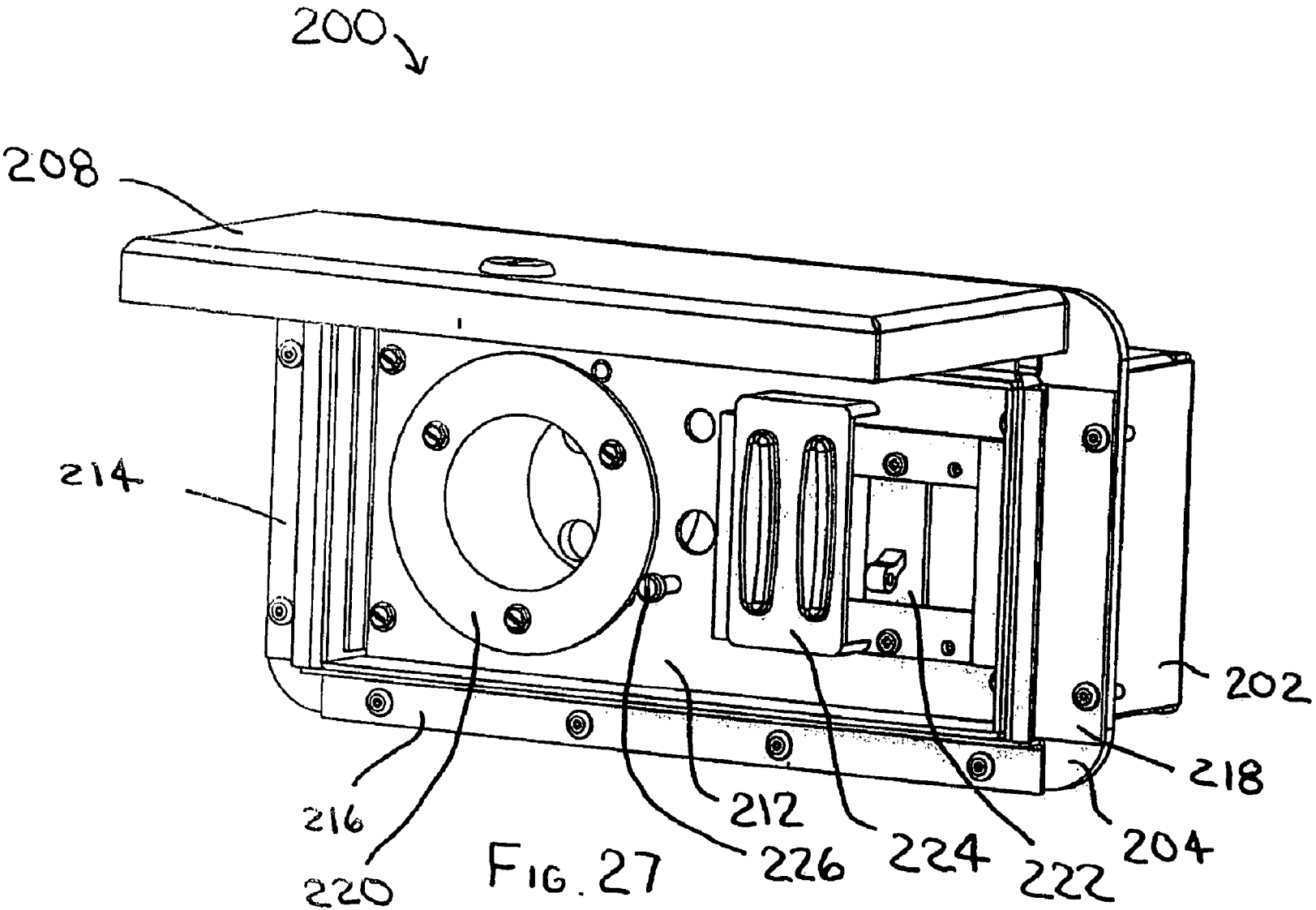
FIG. 27 is a perspective view of the flush-mounted traffic signal transfer switch according to an alternative embodiment of the invention, shown in an open configuration.

FIG. 21 is a perspective view of the faceplate 110, for the surface-mounted transfer switch. FIG. 22 is a front elevation thereof. FIG. 23 is a top plan view thereof. FIG. 24 is a side elevation thereof, and FIG. 25 is a rear fragmentary elevation thereof. Faceplate 110 includes front plate 112, bottom plate 114 for attaching the generator power inlet socket (not shown), side mounting flanges 116, 118, and bottom mounting flange 120. Side mounting flanges 116, 118 include notches 122, 124, which are configured to pivotably engage suitably positioned pins or rivets, extending inwardly from the inside surfaces of sides 54, 56, so that faceplate 110 can hang on and pivot around those pins or rivets, unless and until bottom mounting flange 120 is releasable attached (to permit access for maintenance purposes) to the inside surface of back 58, such as by bolts or machine screws.

Front plate 112 includes aperture 126, suitably dimensioned for from 2-4 circuit breakers to be aligned therewith and affixed, such as by machine screws (through bores 127), as well as apertures 128, 130 for the pilot light and pilot light circuit breaker, as described hereinabove. Bottom plate 114 includes aperture 132, for receiving a generator power inlet socket, to be attached via suitable fasteners into bores surrounding aperture 132, as illustrated.

The surface-mounted transfer switch of the embodiment of FIGS. 6-25 is generally configured to be provided as an "after-market" piece of equipment, to be retro-fitted onto existing traffic signal controllers. To provide a traffic signal transfer switch which is to be integrated into the housing/cabinet of the traffic signal controller (for original installation), as well as to provide for a more streamlined or aesthetic appearance, and as well to provide for a transfer switch construction which is less susceptible to weather as well as tampering or vandalism, a flush-mounted traffic signal transfer switch is provided in the alternative embodiment of the present invention, as shown in FIGS. 26-34. Apart from the structural details of the housing, the electrical components and connections will be the same as in the surface-mounted embodiment of FIGS. 6-25; therefore the electrical schematics of FIGS. 1-5 are applicable to both the surface-mounted and flush-mounted transfer switch configurations.

Figure 29:
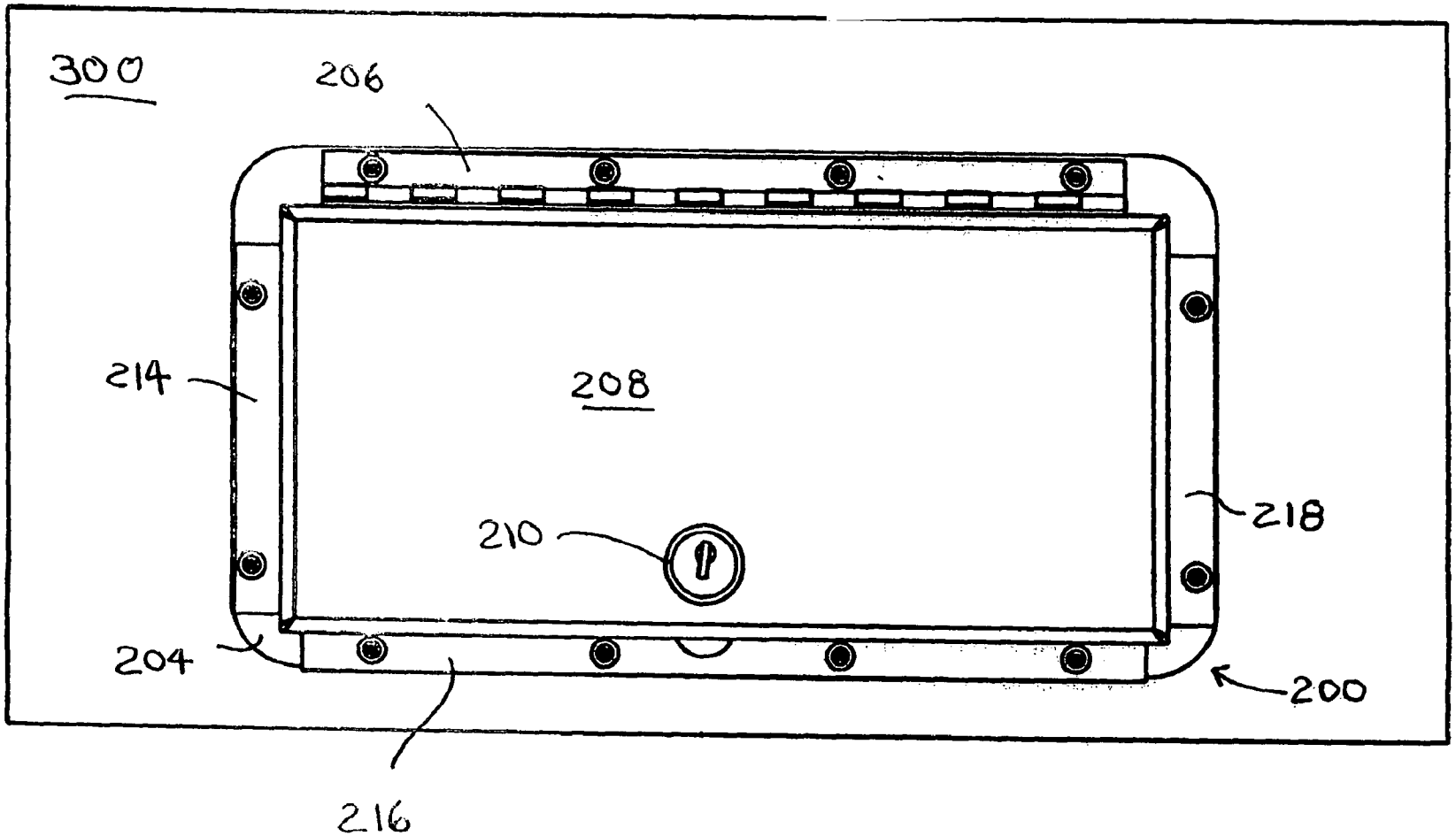
FIG. 29 is a front elevation of the flush-mounted traffic signal transfer switch, shown in closed configuration.
Figure 30:
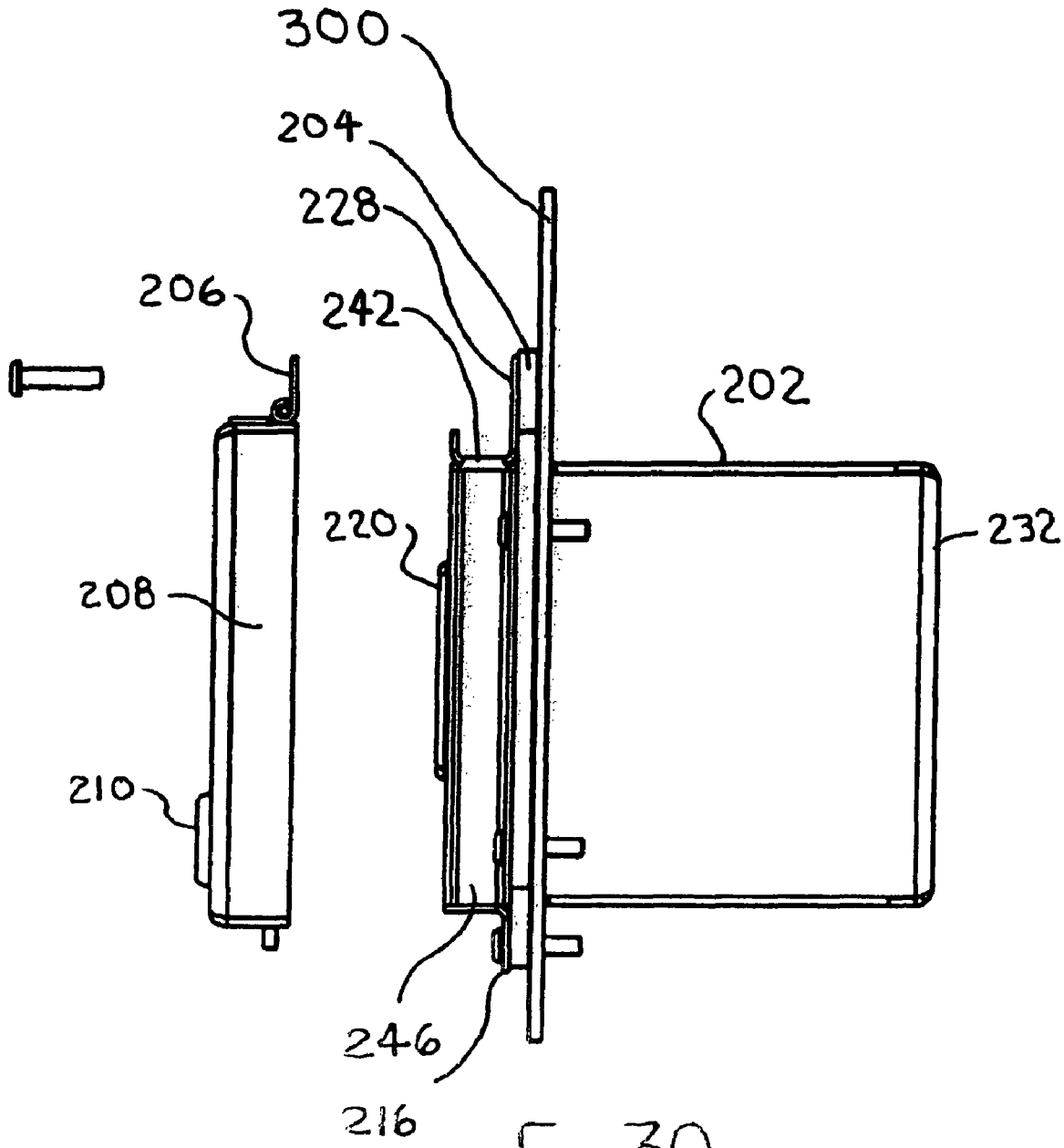
FIG. 30 is a partially exploded side elevation of the flush-mounted traffic signal transfer switch.
Figure 31:
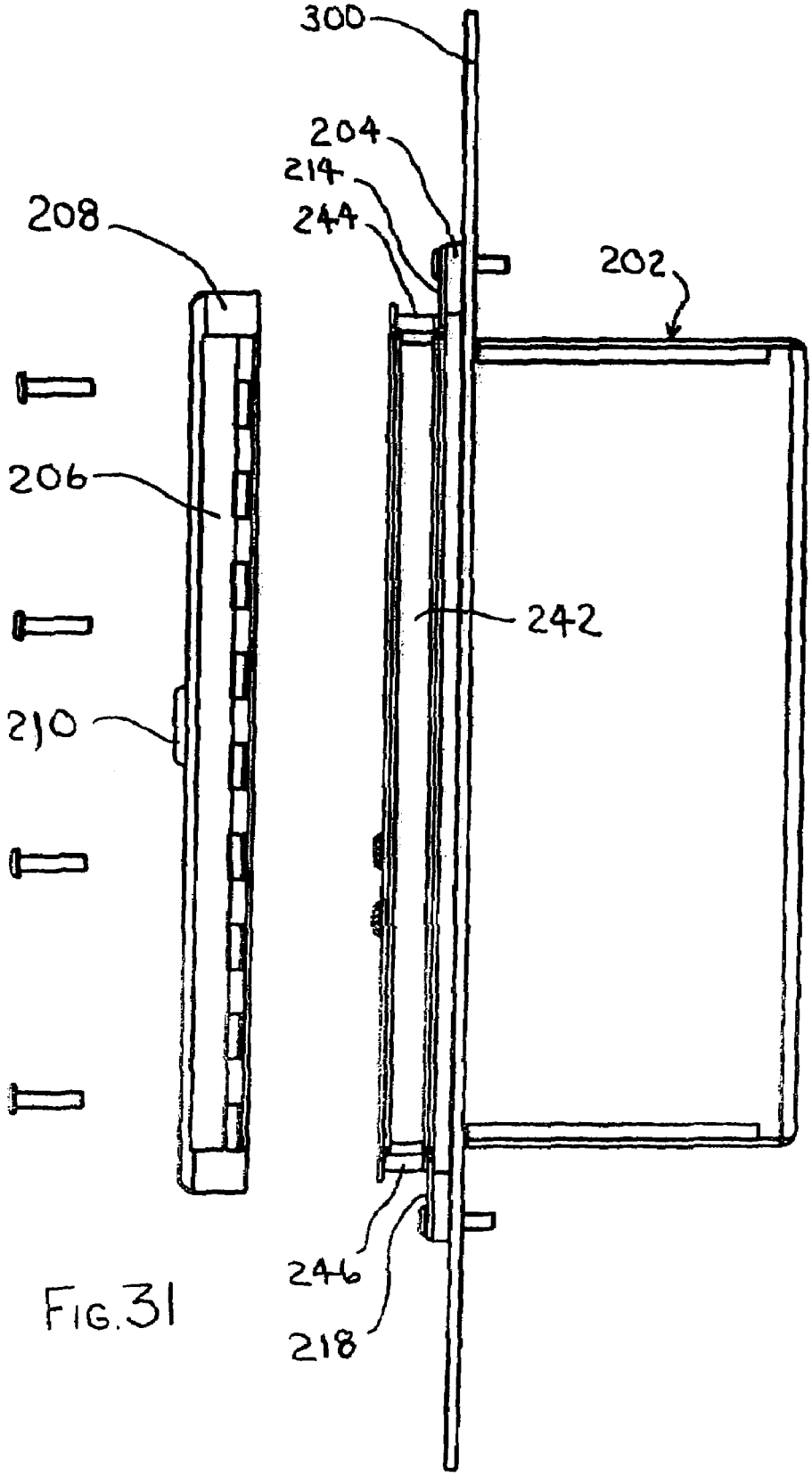
FIG. 31 is a partially exploded top elevation of the flush-mounted traffic signal transfer switch.
Figure 32:
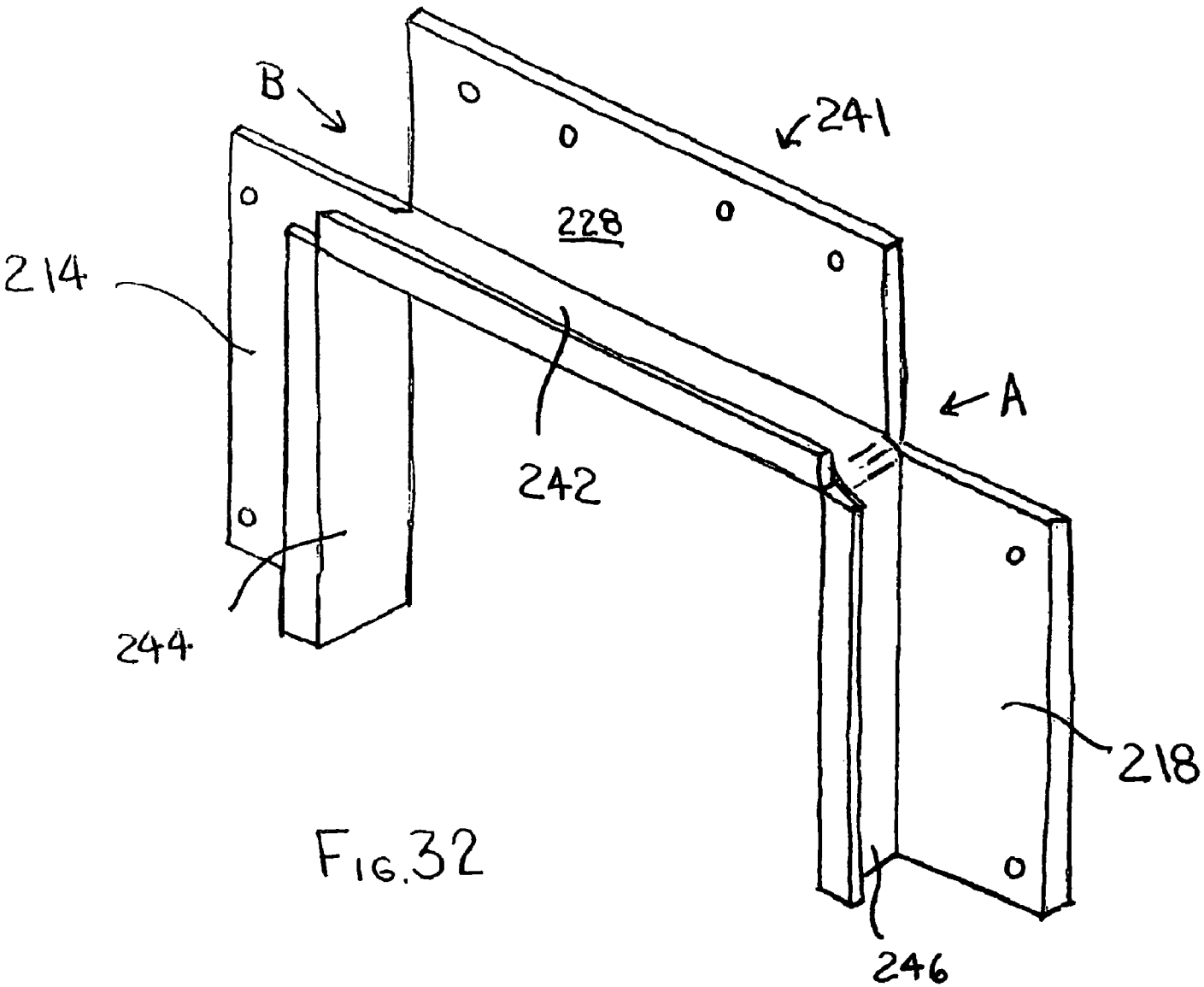
FIG. 32 is a perspective view of the run-off channel structure, for the flush-mounted traffic signal transfer switch.
Figure 33:
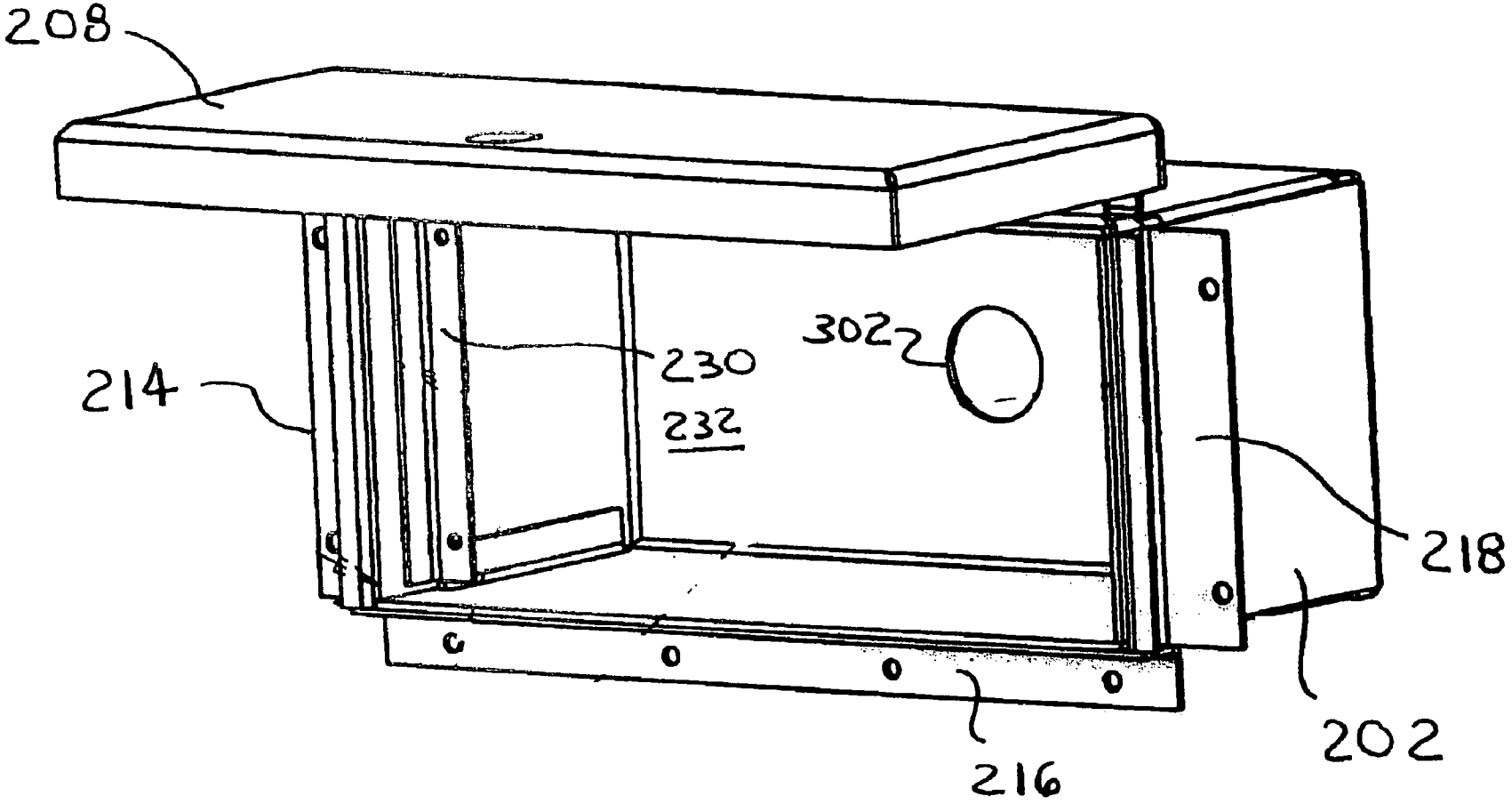
FIG. 33 is a perspective view of the housing and cover for the flush-mounted traffic signal transfer switch, in an open configuration.
Figure 34:
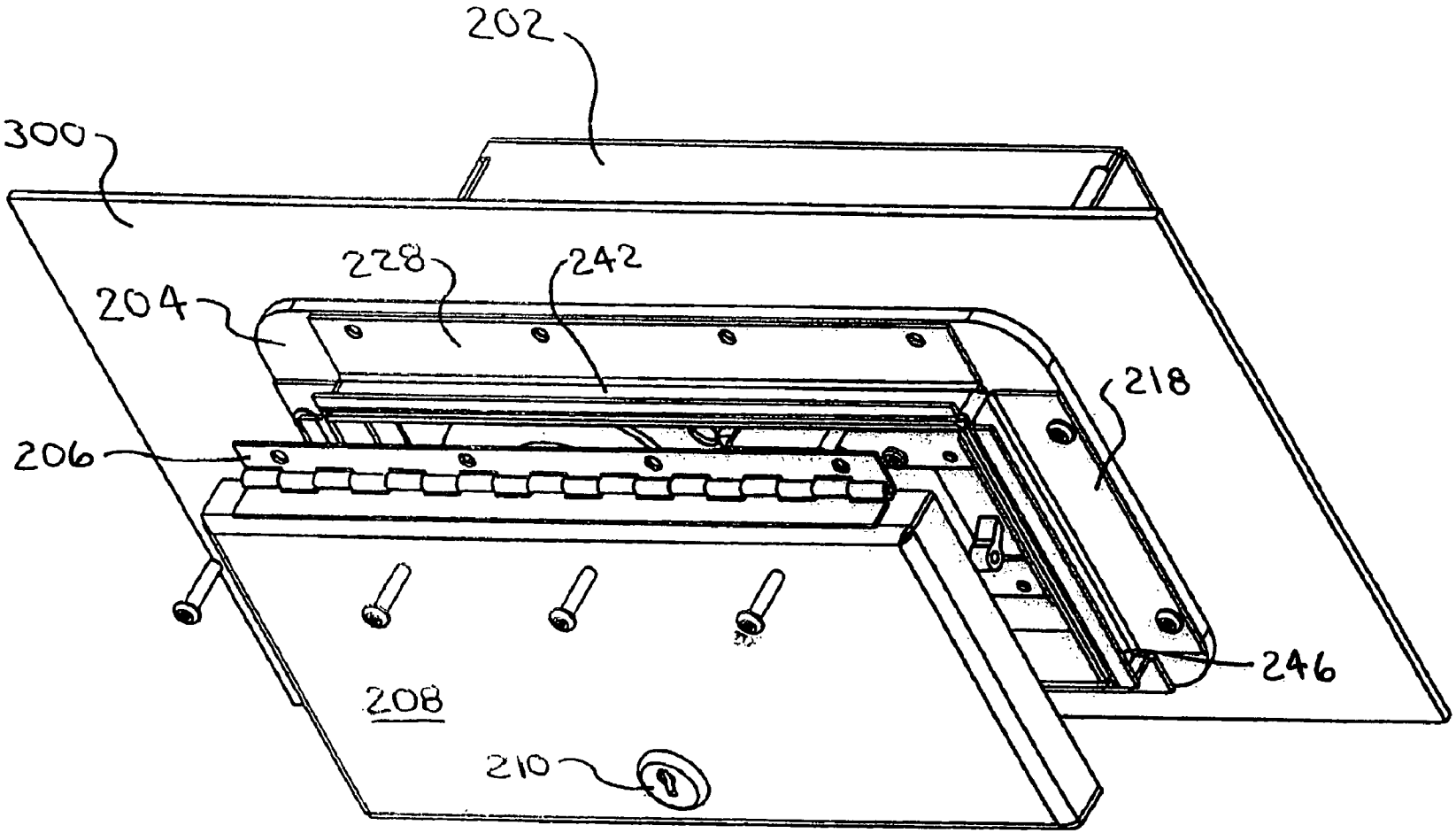
FIG. 34 is a perspective partially exploded view of the flush-mounted traffic signal transfer switch.
Figures 35, 36, 37, 38:
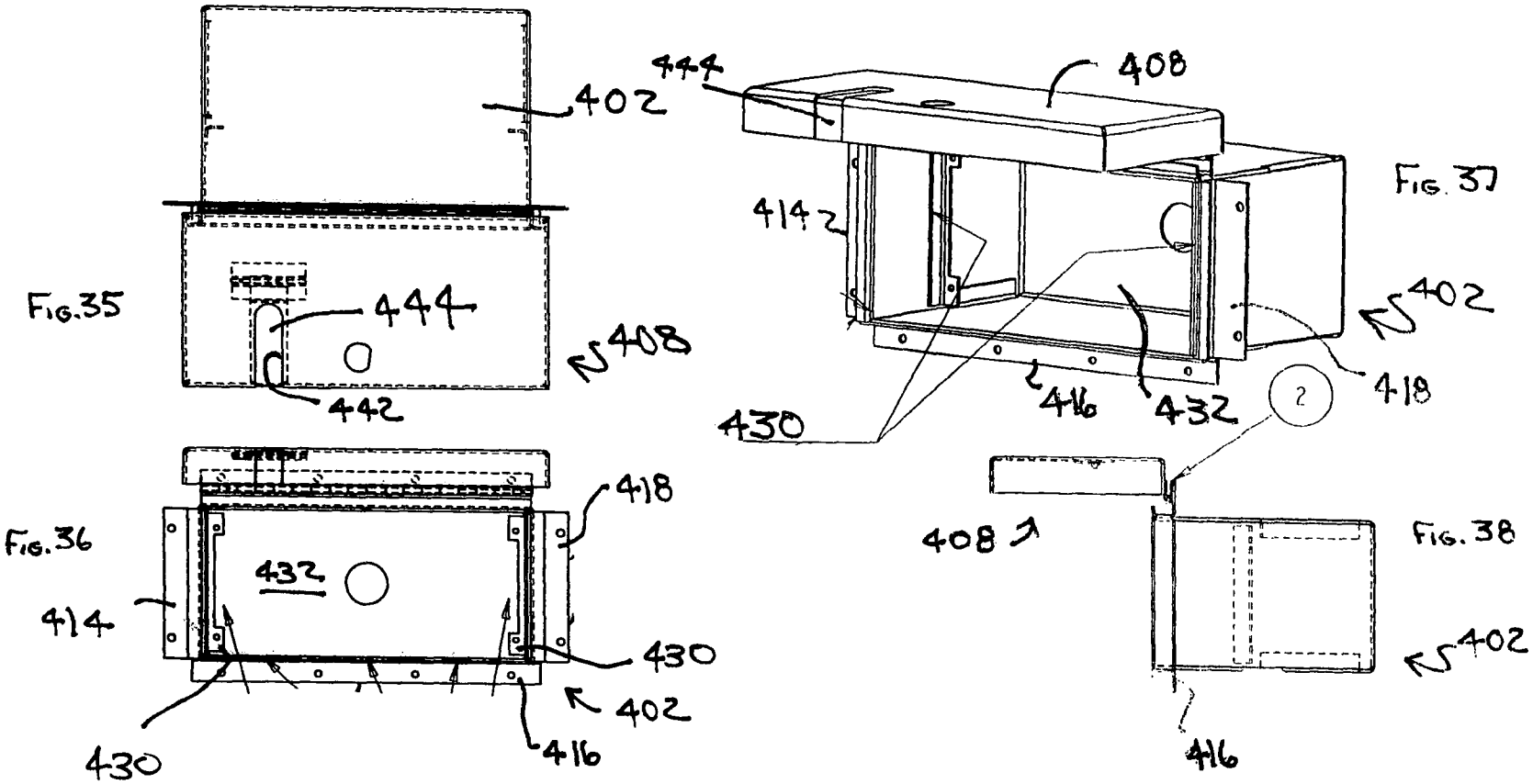
FIG. 35 is a top view of a housing for a flush-mounted traffic signal transfer switch according to an alternative embodiment of the invention.
FIG. 36 is a front elevation thereof.
FIG. 37 is a perspective view thereof.
FIG. 38 is a side elevation thereof.
Figure 40:
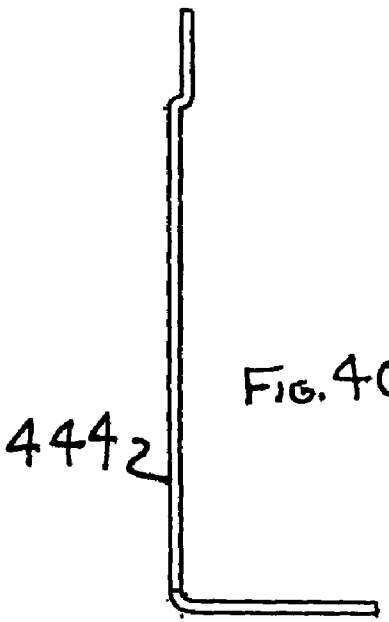
FIG. 40 is a side elevation thereof.
Figure 41:
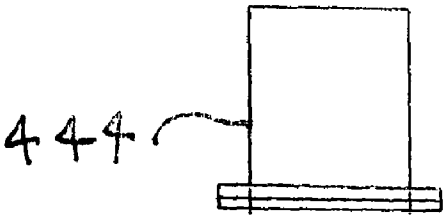
FIG. 41 is a top elevation thereof.
Figure 39:
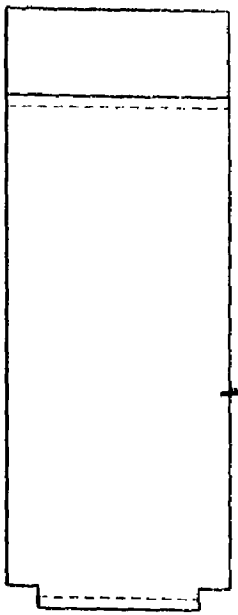
FIG. 39 is a front elevation of the cord access door for the flush-mounted traffic signal transfer switch, according to the embodiment of FIG. 35.
Figure 43:
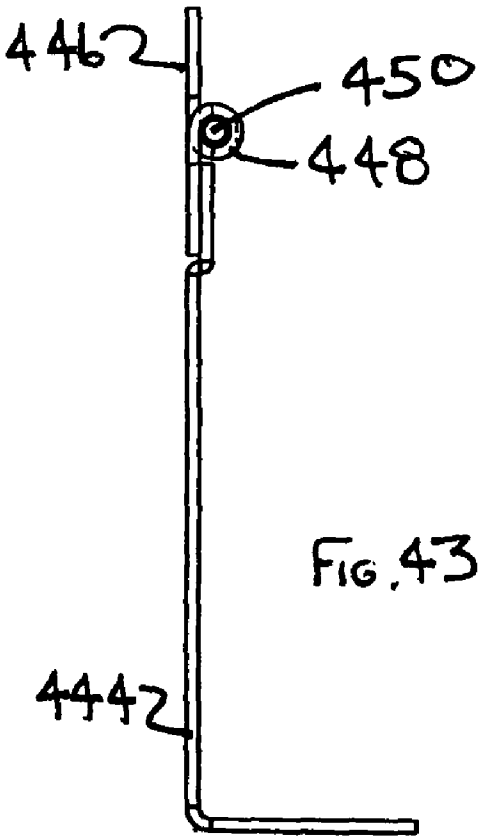
FIG. 43 is a side elevation thereof.
Figure 42:
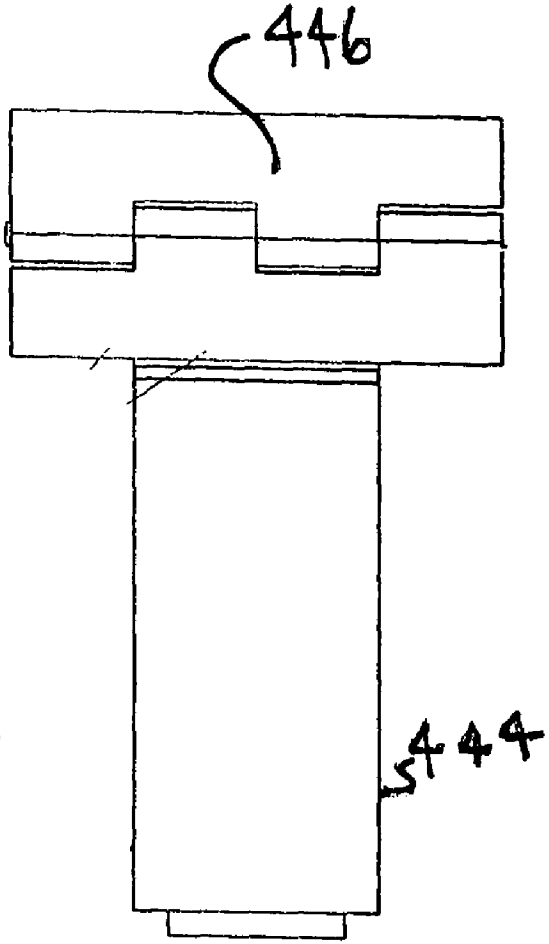
FIG. 42 is a front elevation of the cord access door for the flush-mounted traffic signal transfer switch according to the embodiment of FIG. 35, showing also the mounting tab and hinge structure.
Figure 44:
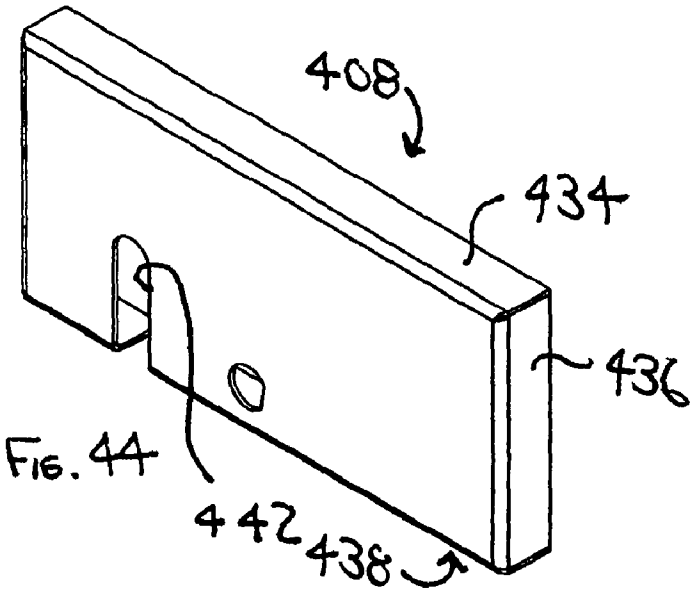
FIG. 44 is a perspective view of the cover for the flush-mounted traffic signal transfer switch according to the embodiment of FIG. 35, without the cord access door.
Figure 46:
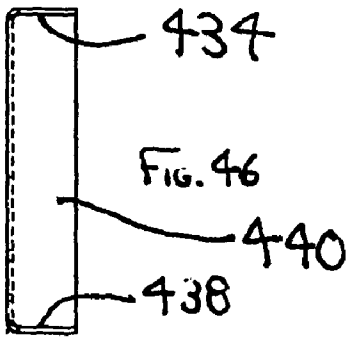
FIG. 46 is a side elevation thereof.
Figure 47:
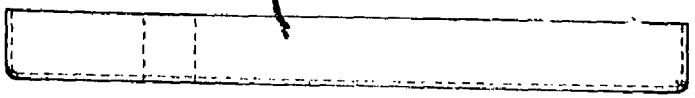
FIG. 47 is a top view thereof.
Figure 45:
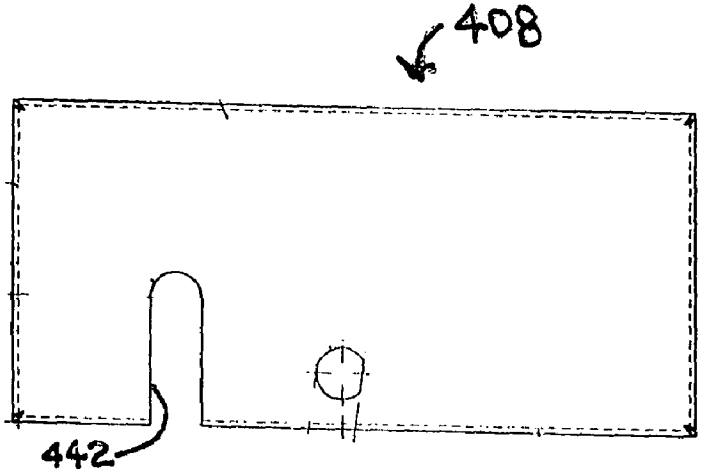
FIG. 45 is a front elevation thereof.
Figure 48:
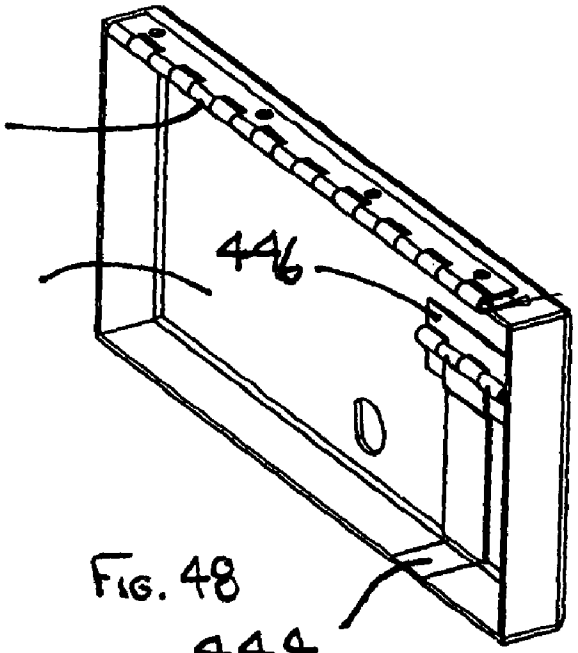
FIG. 48 is a rear perspective view of the cover for the flush-mounted traffic signal transfer switch according to the embodiment of FIG. 35, with the cord access door in place, in its closed position.
Figure 51:
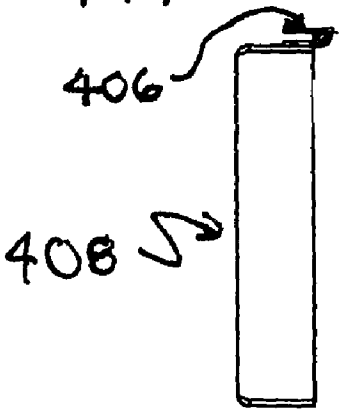
FIG. 51 is a side elevation thereof.
Figure 49:
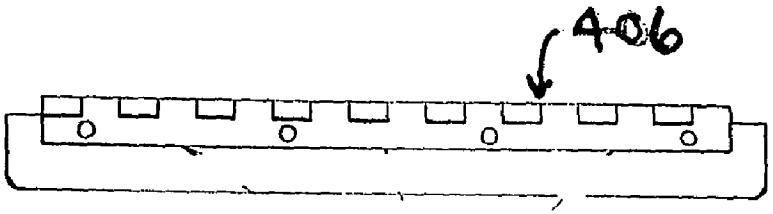
FIG. 49 is a top view thereof, showing the cover hinge.
Figure 50:
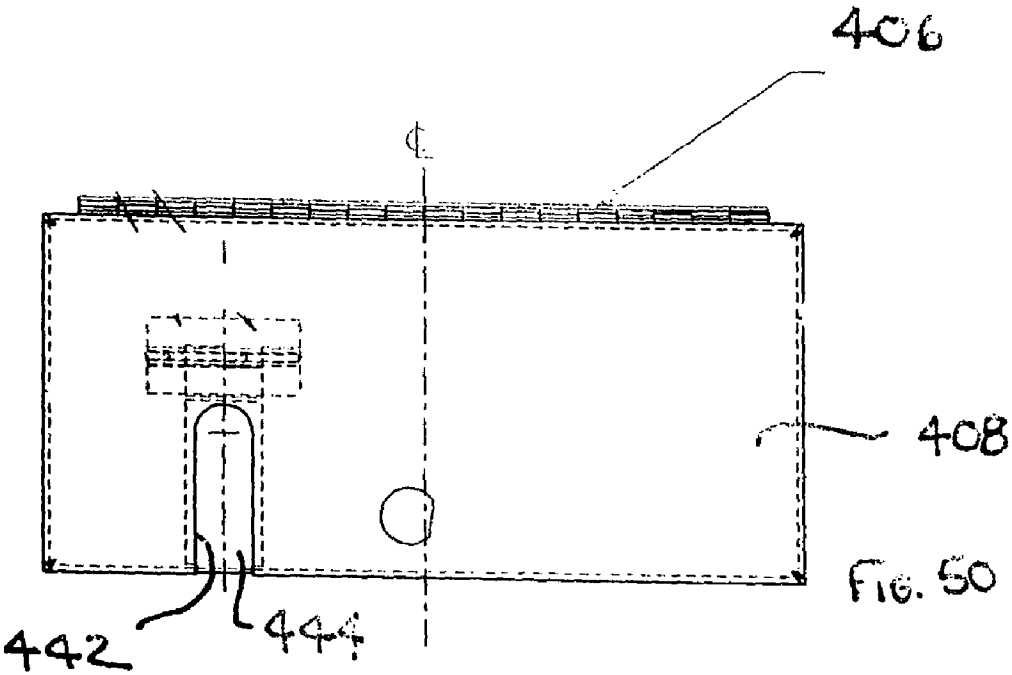
FIG. 50 is a front elevation thereof.
Figure 51:
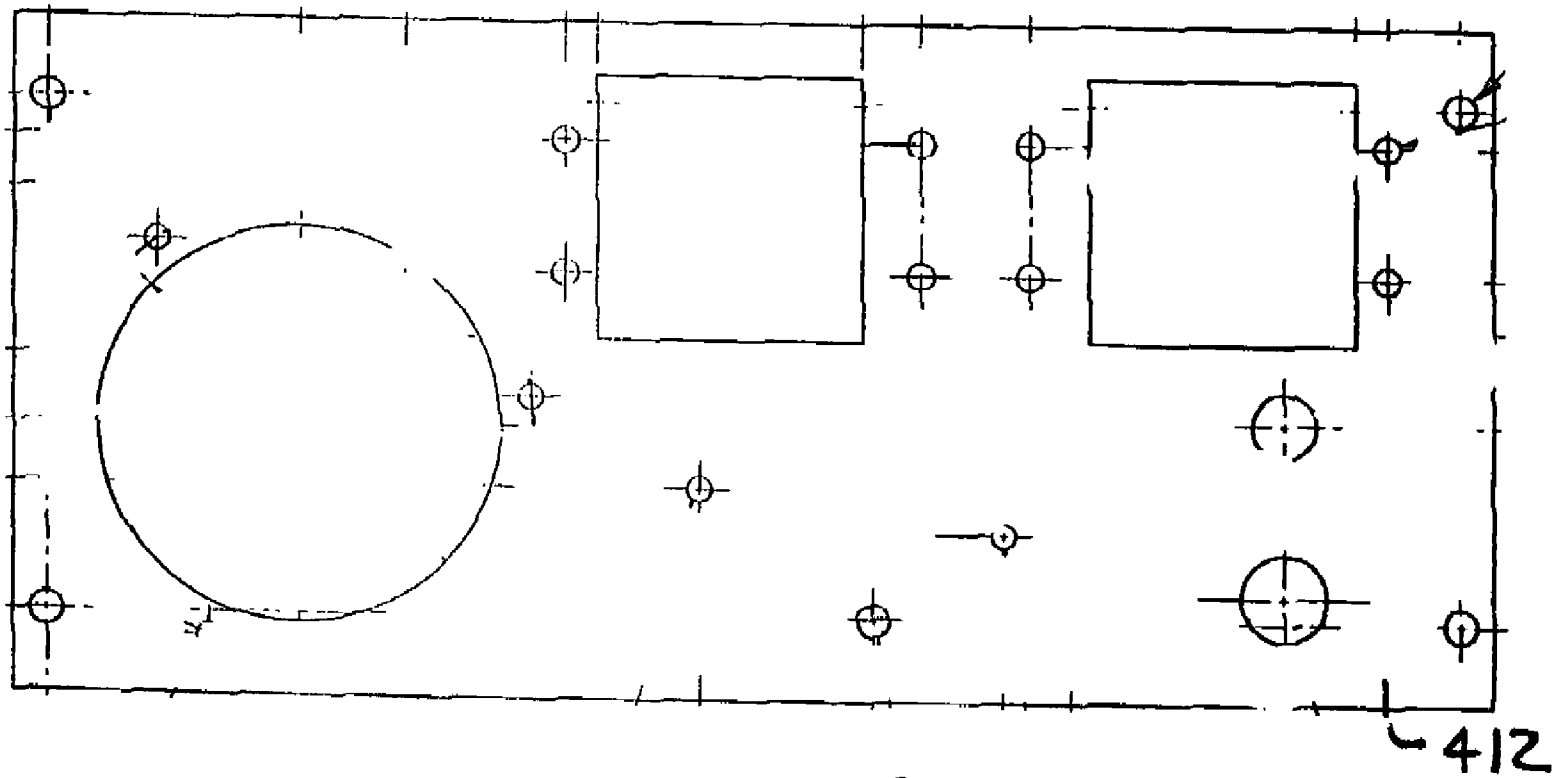
Figure 53:
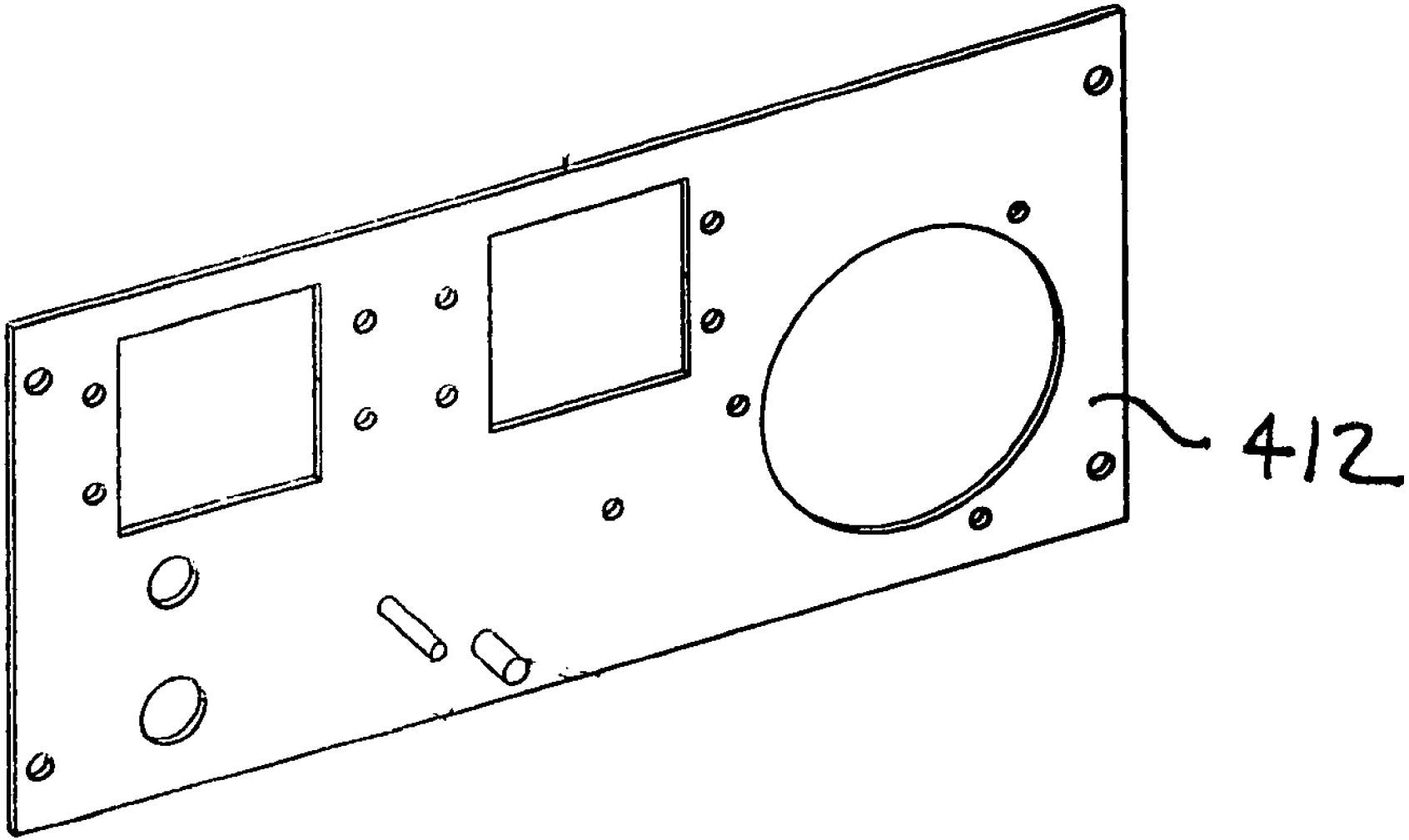
FIG. 53 is a rear perspective view thereof.

Flush-mounted transfer switch 200 is configured to be fitted into an aperture within the cabinet of a traffic signal controller, a portion of the wall 300 of which is shown in FIGS. 29-31, such that the electrical components are within the interior of the traffic signal controller, as well as being surrounded by the housing of the transfer switch itself.

Figure 28:
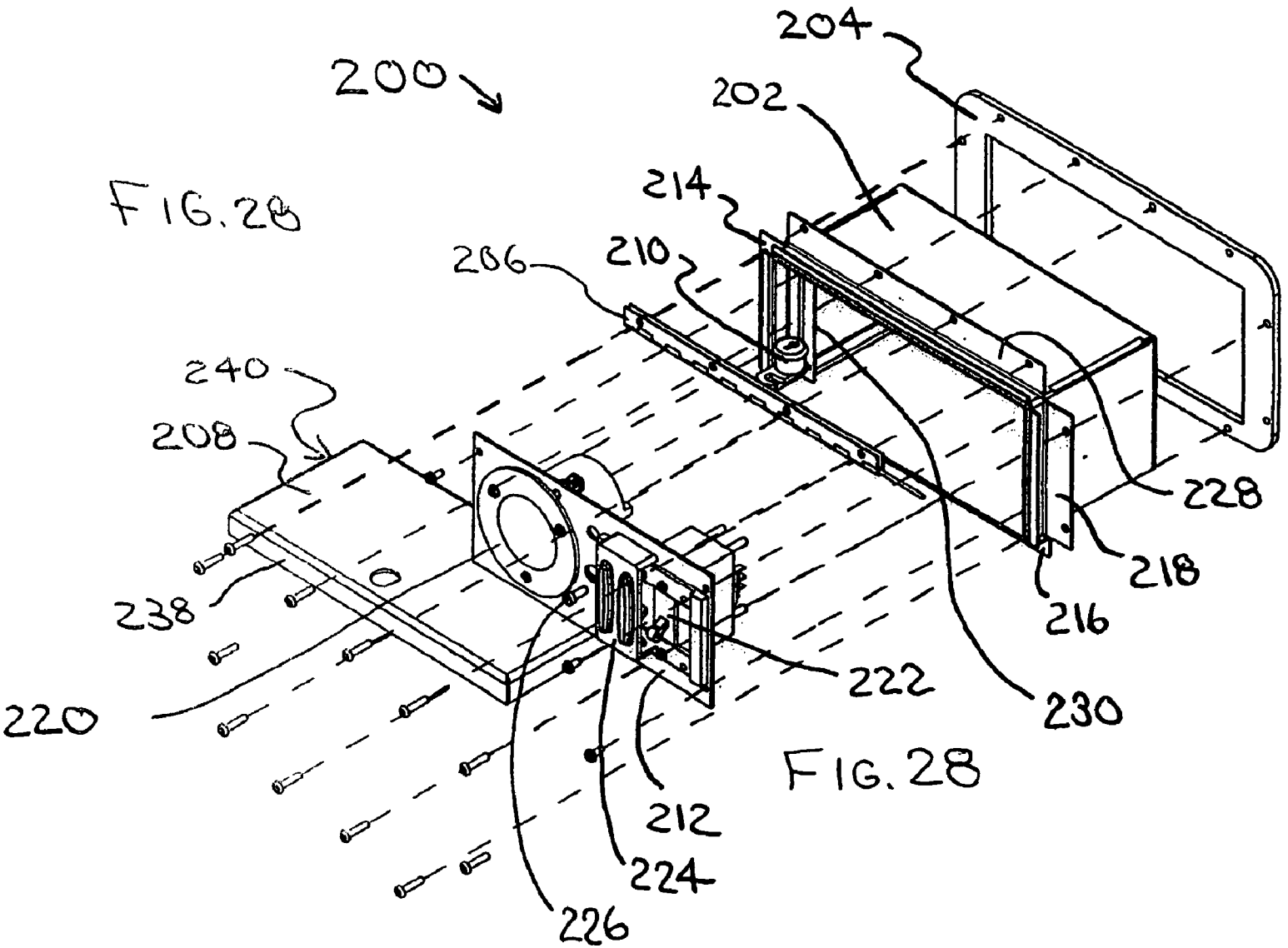
FIG. 28 is an exploded, perspective view of a flush-mounted traffic signal transfer switch according to an alternative embodiment of the invention.

Flush-mounted transfer switch 200 includes housing 202, gasket 204 (for the interface between the traffic signal controller cabinet 300 and housing 202), hinge 206, cover 208, lock 210, face plate 212, housing mounting side flange 214, housing mounting bottom flange 216, housing mounting side flange 218, power inlet power inlet 220, breaker switches 222 covered by lockout mechanism 224, and locking bolt 226. Between one leaf of hinge 206 and rectangular mounting frame 204 is vertically extending housing mounting top flange 228 (shown in FIG. 28). Two face plate mounting flanges 230 (one of which is shown in FIG. 28) extend inwardly from opposing side wall inside surfaces of housing 202, and are provided with suitable fastener apertures (or other means) for mounting face plate 212.

Housing 202 may be fabricated from suitable metal material using any suitable fabrication method, to produce a top wall, a bottom wall, two side walls, and a rear wall, and a front opening. Such a basic structure may be readily formed and fabricated by one of ordinary skill in the art, having the present disclosure before them. Rear wall 232 of housing 202 will have one or more suitably positioned apertures (e.g., aperture 302) or knockouts, to provide required access to make the necessary electrical connections.

The outermost edges of housing 202, extend outwardly beyond flanges 214, 216, 218 and 228. Cover 208 is provided with rearwardly extending flanges 234, 236, 238, 240, which cover the outermost edges of housing 202, to substantially preclude intrusion by water, dust, etc.

To provide transfer switch 200 with the required degree of weatherproof capability, without the need for gaskets, seals or other structures, housing 202 is provided with water run-off channels, extending across the top edge of the opening of housing 202, and down along the side edges of the opening of housing 202, so that should any rainwater or snowmelt get past cover 208, or between hinge 206 and flange 228, it will be directed to the sides and downwardly, and not back under the top edge of the opening, toward the face plate. These run-off channels (e.g., channel 242, FIG. 30) have J-shaped cross-sectional configurations. In an embodiment of the invention (see FIG. 32, not to scale), the horizontally extending run-off channel 242 and vertically extending run-off channels 244, 246 are all originally formed as a single elongated member 241 having a J-shaped cross-section, which is cut at two locations A and B, corresponding to the corners where the top edge of the housing opening meets the side edges of the housing opening, and then bent at those locations. Thus, flanges 214, 228 and 218 are formed integrally with channels 242, 244 and 246. This results in the structure shown in FIG. 32, having rectangular gaps. However, in ordinary usage, these gaps are not believed to enable any significant infiltration of water toward the interior of transfer switch 200. Alternatively, the rectangular gaps may be filled with a sealing structure, such as silver caulk or a bead of welding material appropriate to the metal of the run-off channels, though using a bead of welding material is typically more difficult to maintain in position and fill the gap, compared to a metal caulking material.

The use of the run-off channels is believed to provide for a substantially weatherproof construction, without requiring the use of elastomeric gaskets or seals. Member 241 is then spot welded to the outside of housing 202. As J-shaped channel is not believed required for the bottom of housing 202, flange 216 may simply be provided by a straight length of L-shaped material that is welded along the outside of the bottom wall of housing 202. Alternatively, a J-shaped section may be employed if desired.

FIGS. 35-68 illustrate another embodiment of the invention, in which flush-mounted transfer switch 400 is configured to be fitted into an aperture within the cabinet of a traffic signal controller 4 (see FIG. 61), in a manner similar to that of the embodiment of FIGS. 26-34, such that the electrical components are within the interior of the traffic signal controller, as well as being surrounded by the housing of the transfer switch itself.

Flush-mounted transfer switch 400 includes housing 402, a gasket 404 similar to gasket 204 (for the interface between the traffic signal controller cabinet and housing 402), hinge 406, cover 408, a lock (not shown, but may be similar to lock 210), face plate 412, housing mounting side flange 414, housing mounting bottom flange 416, housing mounting side flange 418, power inlet power inlet 420, breaker switches 422 covered by interlock mechanism 424, and locking bolt 426. Between one leaf of hinge 406 and rectangular mounting frame 404 is vertically extending housing mounting top flange 428. Two face plate mounting flanges 430 (having L-shaped cross-sections) extend inwardly from opposing side wall inside surfaces of housing 402, and are provided with suitable fastener apertures (or other means) for mounting face plate 412.

Housing 402 may be fabricated from suitable metal material using any suitable fabrication method, to produce a top wall, a bottom wall, two side walls, and a rear wall, and a front opening. Such a basic structure may be readily formed and fabricated by one of ordinary skill in the art, having the present disclosure before them. Rear wall 432 of housing 402 will have one or more suitably positioned apertures (e.g., aperture 402) or knockouts, to provide required access to make the necessary electrical connections.

The outermost edges of housing 402, extend outwardly beyond flanges 414, 416, 418 and 428. Cover 408 is provided with rearwardly extending flanges 434, 436, 438, 440, which cover the outermost edges of housing 402, to substantially preclude intrusion by water, dust, etc.

As in the embodiment of FIGS. 26-34, to provide transfer switch 400 with the required degree of weatherproof capability, without the need for gaskets, seals or other structures, housing 402 is provided with water run-off channels, extending across the top edge of the opening of housing 402, and down along the side edges of the opening of housing 402, so that should any rainwater or snowmelt get past cover 408, or between hinge 406 and flange 428, it will be directed to the sides and downwardly, and not back under the top edge of the opening, toward the face plate. These run-off channels (similar to channel 242) have J-shaped cross-sectional configurations. In an embodiment of the invention, the horizontally extending run-off channel and vertically extending run-off channels (like channels 242, 244 and 246) are all originally formed as a single elongated member having J-shaped cross-section, which is cut at two locations A and B, corresponding to the corners where the top edge of the housing opening meets the side edges of the housing opening, and then bent at those locations. Thus, flanges 414, 428 and 418 may be formed integrally with channels 442, 444 and 446. This results in the structure having rectangular gaps. However, in ordinary usage, these gaps are not believed to enable any significant infiltration of water toward the interior of transfer switch 400. Alternatively, the rectangular gaps may be filled with a sealing structure, such as silver caulk or a bead of welding material appropriate to the metal of the run-off channels, though using a bead of welding material is typically more difficult to maintain in position and fill the gap, compared to a metal caulking material.

In still another alternative embodiment, the structures forming the channels may be formed as separate components, which are then attached, e.g., via welding, brazing, etc., to housing 402; however, the function of the resulting channel structures will be the same.

The use of the run-off channels is believed to provide for a substantially weatherproof construction, without requiring the use of elastomeric gaskets or seals. Member 241 is then spot welded to the outside of housing 402. As J-shaped channel is not believed required for the bottom of housing 402, flange 416 may simply be provided by a straight length of L-shaped material that is welded along the outside of the bottom wall of housing 402. Alternatively, J-shaped section may be employed if desired.

In order to further improve the weather-resistance of transfer switch 400, transfer switch 400 is provided with cover 408, which has a further cord access opening 442 and cord access door 444. Cord access opening 442 comprises a notch formed (e.g., by stamping, die-cutting, etc.) in cover 408, to provide an elongated opening or gap, which positioned to align with the location of power inlet 420. Cord access opening 442 extends from a position on the interior of cover 408, outwardly, to an edge region of flange 438. Cord access door 444 is, in side elevation, an L-shaped member, which is pivotably mounted, relative to cover 408, via mounting tab 446, and hinge structure 448 formed in mating portions of cord access door 444 and mounting tab 446, with hinge pin 450 joining the respective mating portions together. Mounting tab 446 is attached to an inner surface of cover 408, above cord access opening 442. In this way, cord access door 444 is configured to pivot inwardly and upwardly relative to cover 408. Thus, when a power inlet cord and plug 452 is inserted into power inlet 420, and cord access door 444 has been pivoted upwardly, cover 408 may be closed completely leaving only a small gap in the area surrounding and below power inlet cord and plug 452.

While cord access door 444 has been shown as being configured for upward/downward pivoting, in an alternative embodiment of the invention, the cable access door may be configured for pivoting movement around a vertical hinge. Alternatively, it may be configured for sliding vertical or lateral movement. In addition, a biasing structure, such as a spring, may be provided to prompt the cord access door into a closed position, when a power inlet cord is not plugged into the transfer switch.

Figure 54:
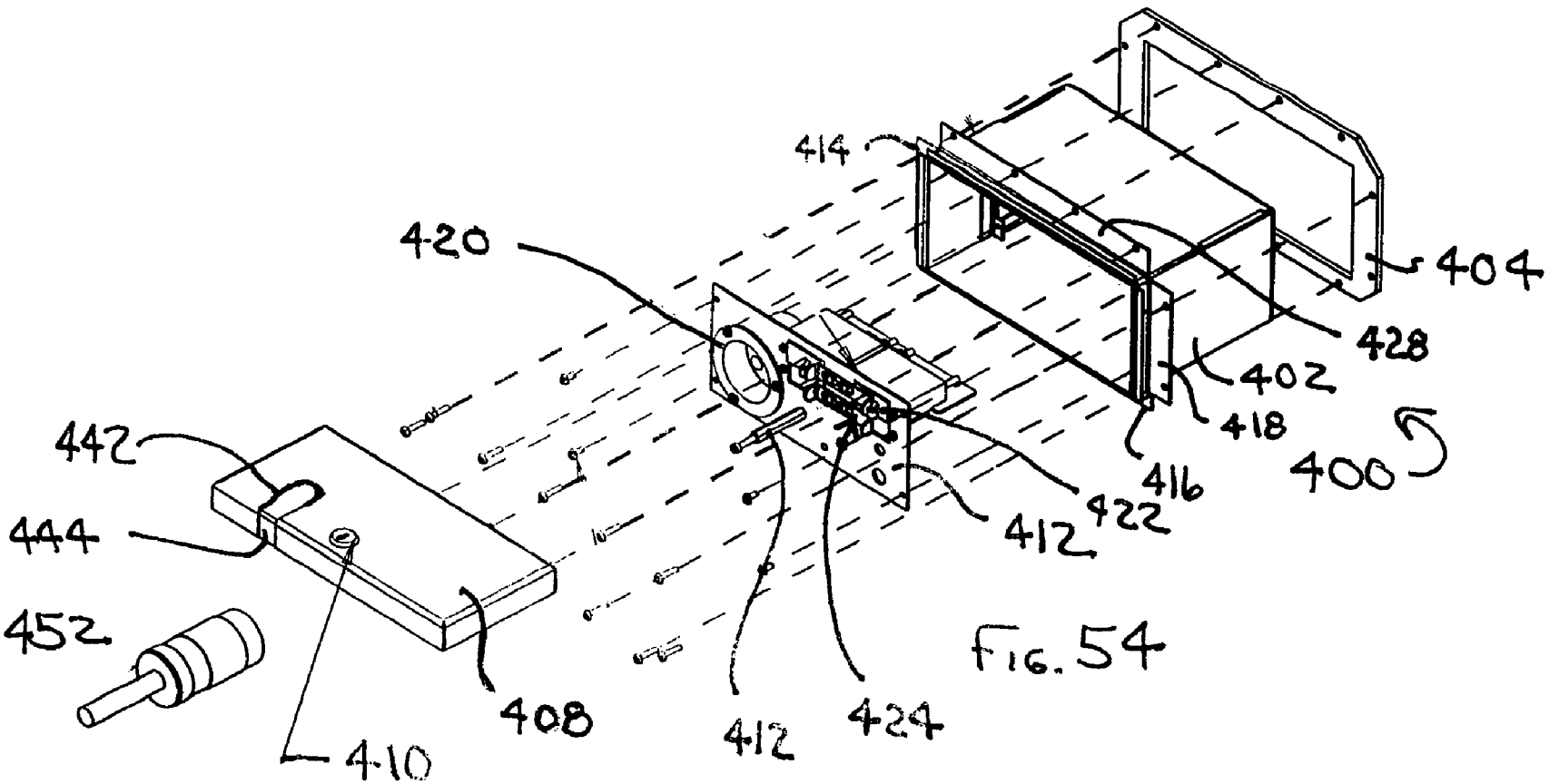
FIG. 54 is an exploded perspective view of the flush-mounted traffic signal transfer switch according to the embodiment of FIG. 35, which is configured for a two-phase circuit, or for a single phase circuit with neutral circuit breakers.
Figure 57:
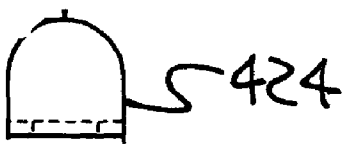
FIG. 57 is an end elevation thereof.
Figure 55:
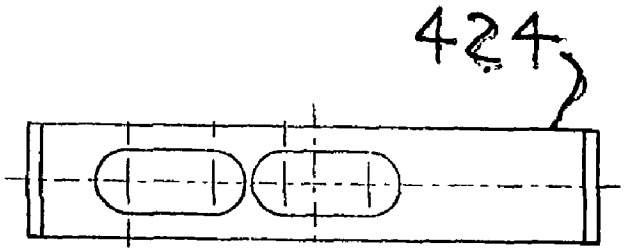
FIG. 55 is a top view of an interlock member according to the embodiment of FIG. 35.
Figure 56:
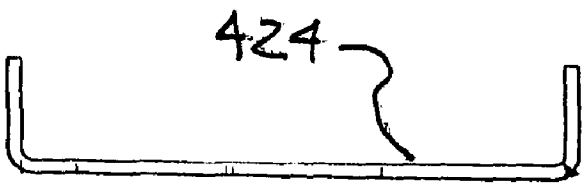
FIG. 56 is a side elevation thereof.
Figure 58:
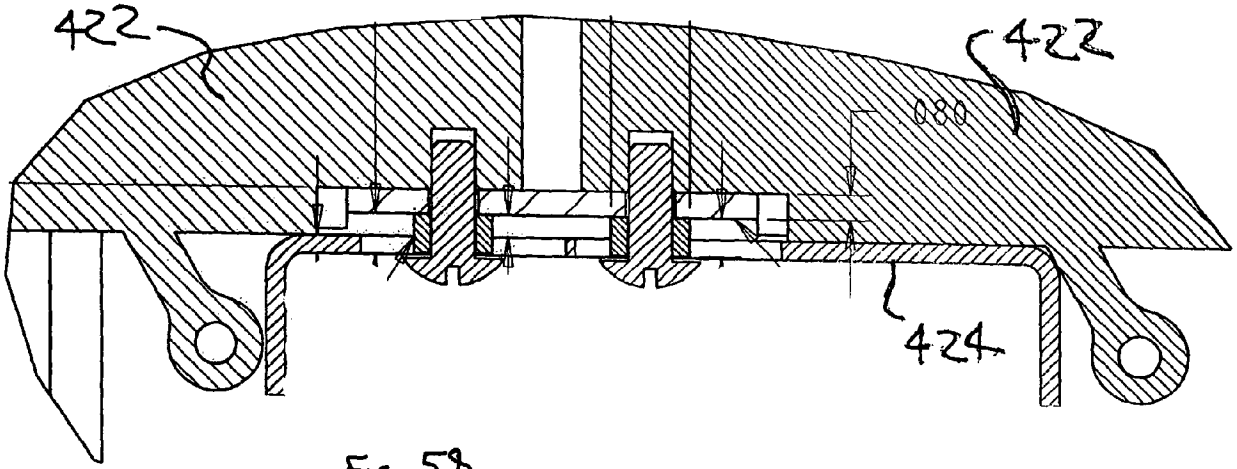
FIG. 58 is an inverted, sectional side elevation of a portion of a pair of tandem breaker switches, showing the positioning of the interlock member.
Figure 59:
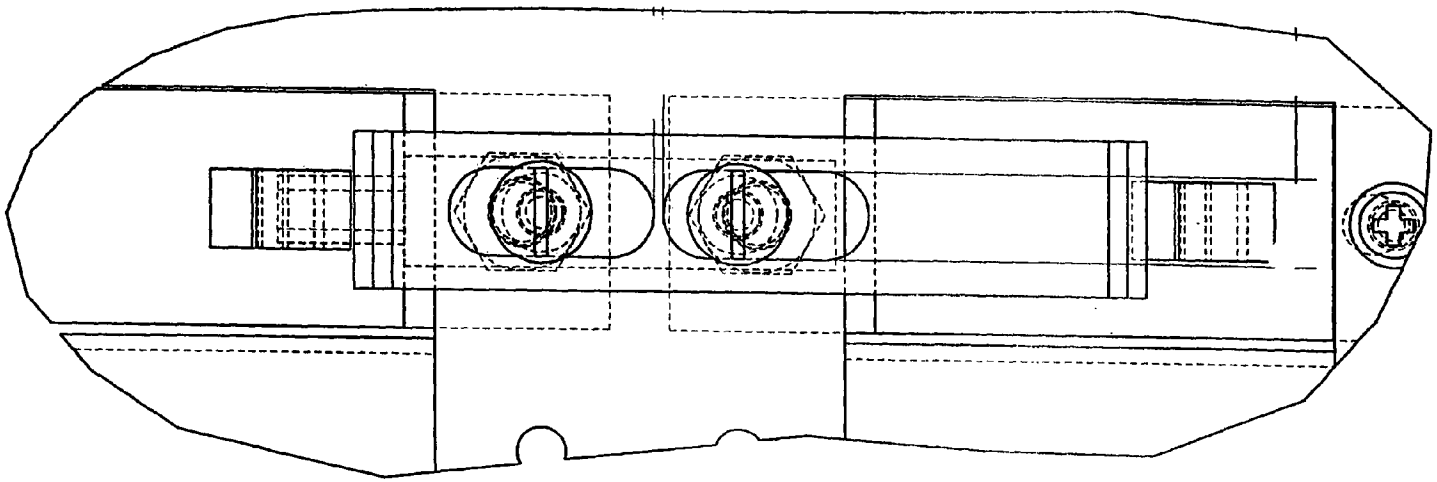
FIG. 59 is a plan view thereof.
Figure 60:
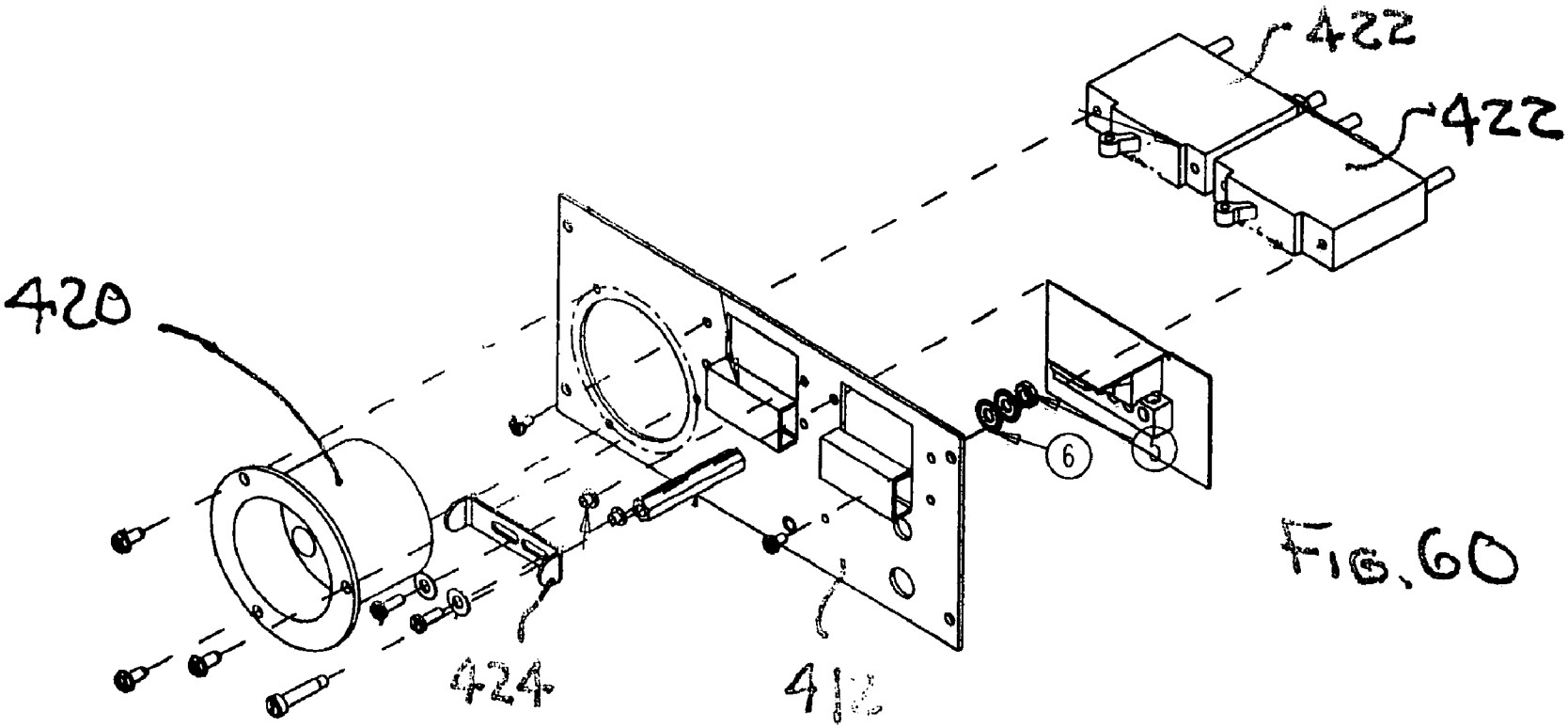
FIG. 60 is an exploded perspective view of the flush-mounted traffic signal transfer switch according to the embodiment of FIG. 35, which is configured for a single-phase circuit, without neutral circuit breakers.

Transfer switch 400 uses, in the illustrated embodiment, one pair of breaker switches 422, which are mounted in tandem (in which the pivot axes of cooperating breaker switch handles are parallel), and not side-by-side (in which the pivot axes of cooperating breaker switch handles are coaxial, as in the embodiment of FIGS. 26-34). One breaker will be associated with the power circuit between the utility and the load (e.g., household circuit), and the other breaker will be associated with the power circuit between the auxiliary generator and the load. If each breaker 422 is a single pole breaker, it will typically have a single switch handle (as shown in FIG. 60), which is analogous to the switching arrangement of the embodiment of FIG. 2 hereinabove. If each breaker is a two-pole breaker or actually a pair of side-by-side tandem breaker sets (for accommodating two-phase circuits or a switched neutral circuit, respectively, as described relative to the embodiments of FIGS. 3 and 4 hereinabove), then each breaker will have two side-by-side switch handles (as seen in FIG. 54, where two interlock members are provided). The utility and generator breakers will be oriented "facing away" from one another, so that the respective "ON" positions of the respective switch handles are "toward" the other adjacent breaker, and the "OFF" positions of the respective switch handles are "away" from the adjacent breaker.

In order to prevent both breaker switches from being in the "ON" position, sliding interlock member(s) 424 are provided. Each interlock member 424 is, in an embodiment of the invention, a shallow U-shaped member, having a pair of oblong openings 454 positioned in the base of the "U". Each interlock member is then slidingly bolted to the face of the tandem breakers 422 between the handles of the generator and utility breakers, so that, as a result of the positioning of the openings 454, and the orientation of the openings, when the interlock is positioned between the respective switch handles of the adjacent utility and generator breakers, the switch handles of both breakers cannot physically be both in their respective "ON" positions. Further, by pushing on the switch handle of the breaker which is in the "OFF" position, toward the "ON" position for that switch handle, the interlock will push the handle of the adjacent breaker switch out of its "ON" position, before the other switch handle can arrive at its own "ON" position, thus establishing a "break before make" tandem breaker switch arrangement.

Traffic signal transfer switch 400 of the embodiment of FIGS. 35-68 enables the switching between utility and generator power in a single movement, as compared to the illustrated embodiments of the traffic signal transfer switches of FIGS. 1-34, in which a first breaker must be flipped, to enable the lateral movement of the lockout device, to cover the now "OFF" breaker, and enable access to the breaker which is to be flipped to its "ON" position.

Figure 61:
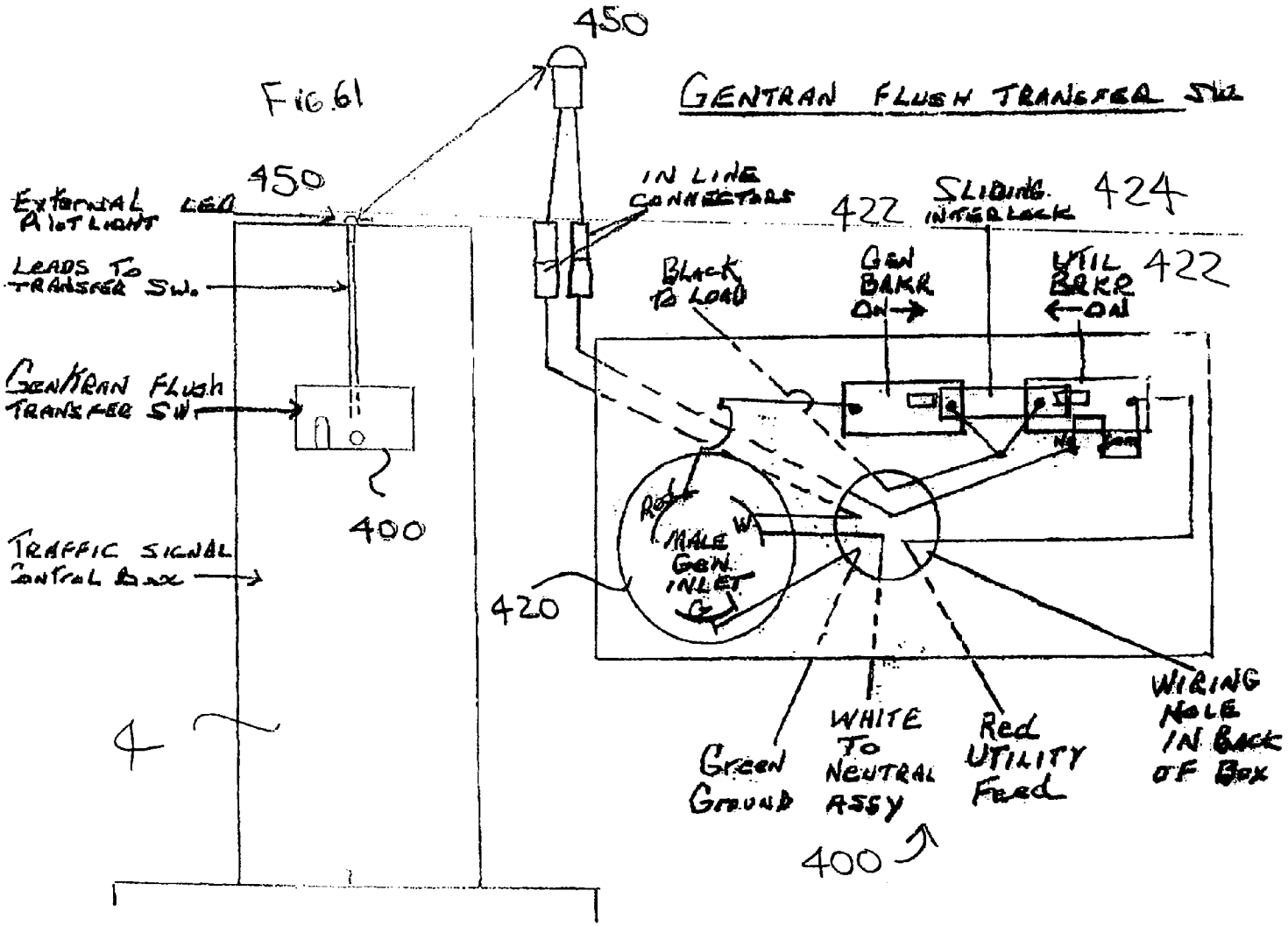
FIG. 61 is a schematic illustration of the flush-mounted traffic signal transfer switch of the sub-embodiment of FIG. 60.
Figure 62:
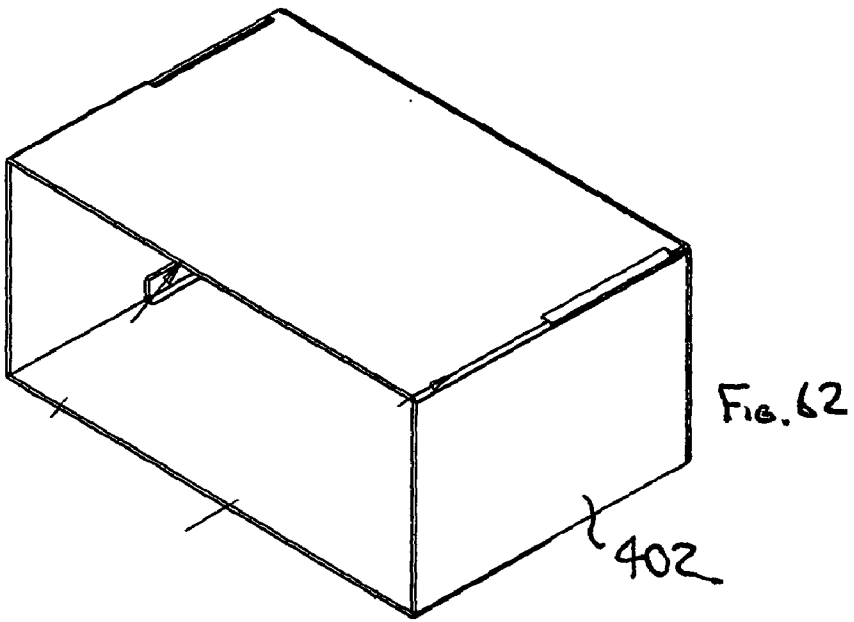
FIG. 62 is a perspective view of the housing for traffic signal transfer switch according to the embodiment of FIG. 35.
Figure 64:
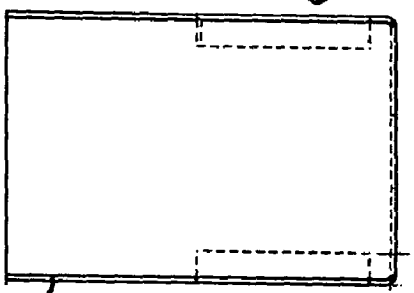
FIG. 64 is a side elevation thereof.
Figure 65:
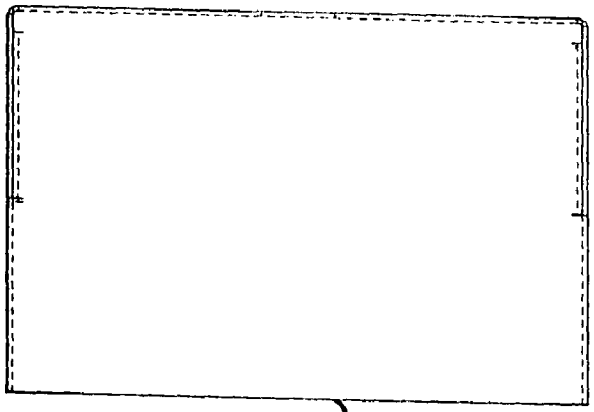
FIG. 65 is a top view thereof.
Figure 63:
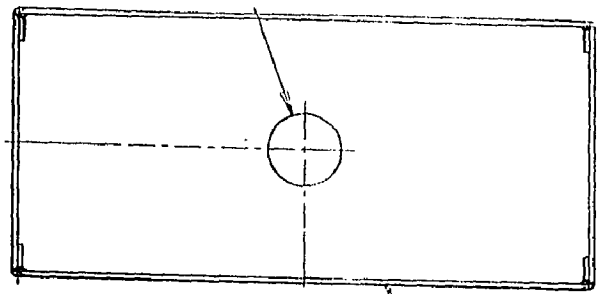
FIG. 63 is a front elevation thereof.
Figure 68:
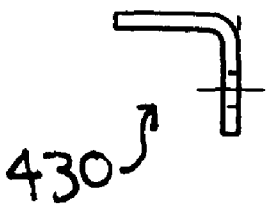
FIG. 68 is a side elevation thereof.
Figure 66:
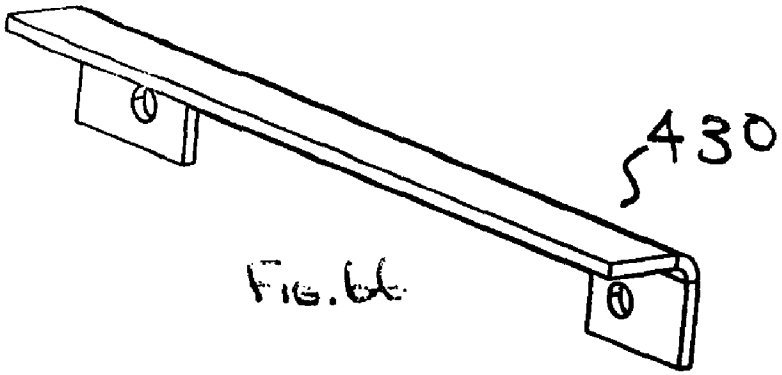
FIG. 66 is a perspective view of a bracket, to be installed within the housing, for mounting the face plate of the traffic signal transfer switch according to the embodiment of FIG. 35.
Figure 67:
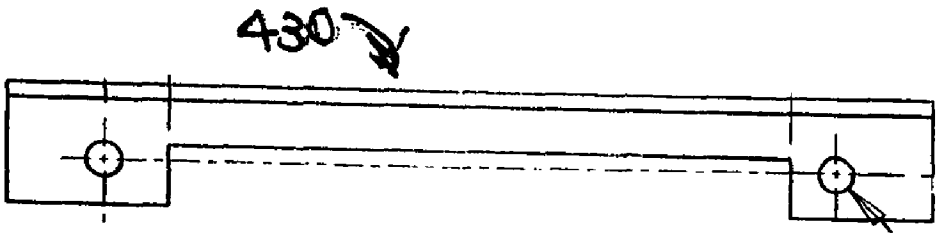
FIG. 67 is a front elevation thereof.
Figure 71:
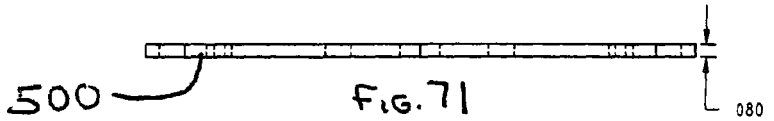
FIG. 71 is a front view thereof.
Figure 70:
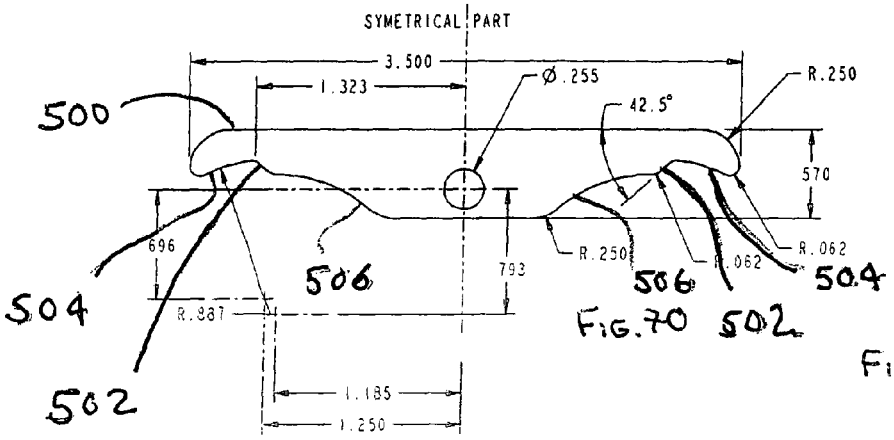
FIG. 70 is a top view thereof.
Figure 69:
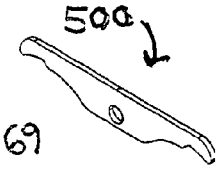
FIG. 69 is a perspective view of a rocker member for an alternative interlock construction.
Figure 73:
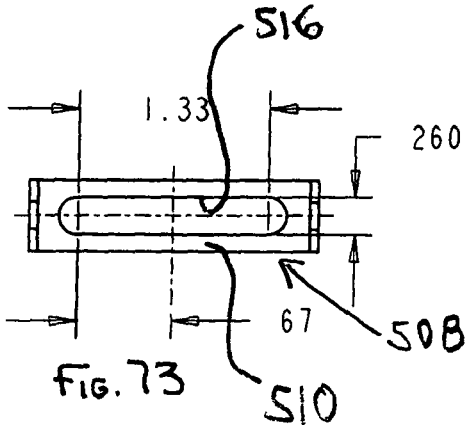
FIG. 73 is a top view thereof.
Figure 72:
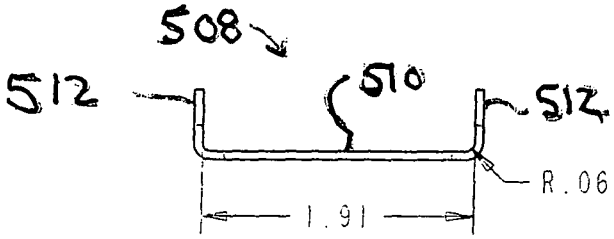
FIG. 72 is a front view of a slide member for an alternative interlock construction.
Figure 74:
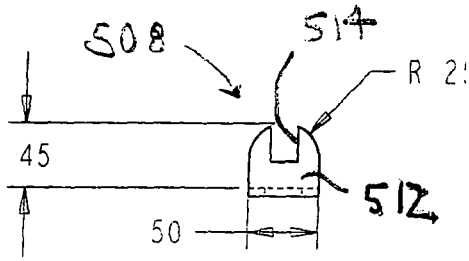
FIG. 74 is an end view thereof.
Figure 78:
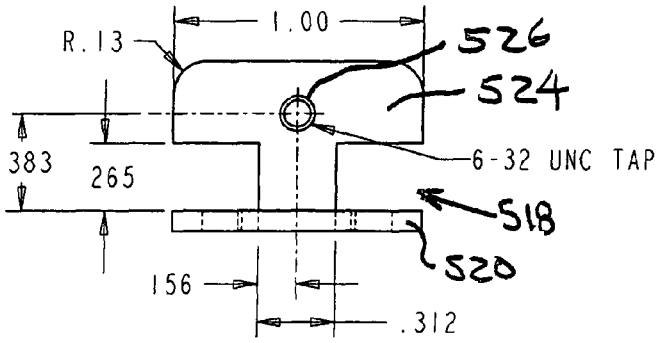
FIG. 78 is a front view thereof.
Figure 75:
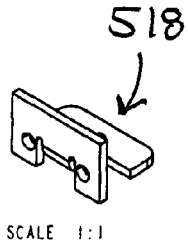
FIG. 75 is a perspective view of a mounting member for an alternative interlock construction.
Figure 77:
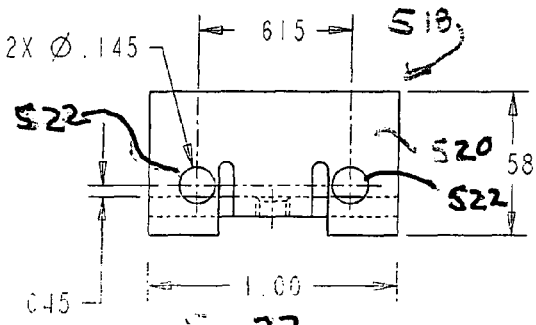
FIG. 77 is a bottom view thereof.
Figure 76:
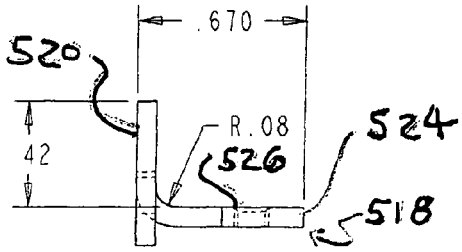
FIG. 76 is an end view thereof.
Figure 79:
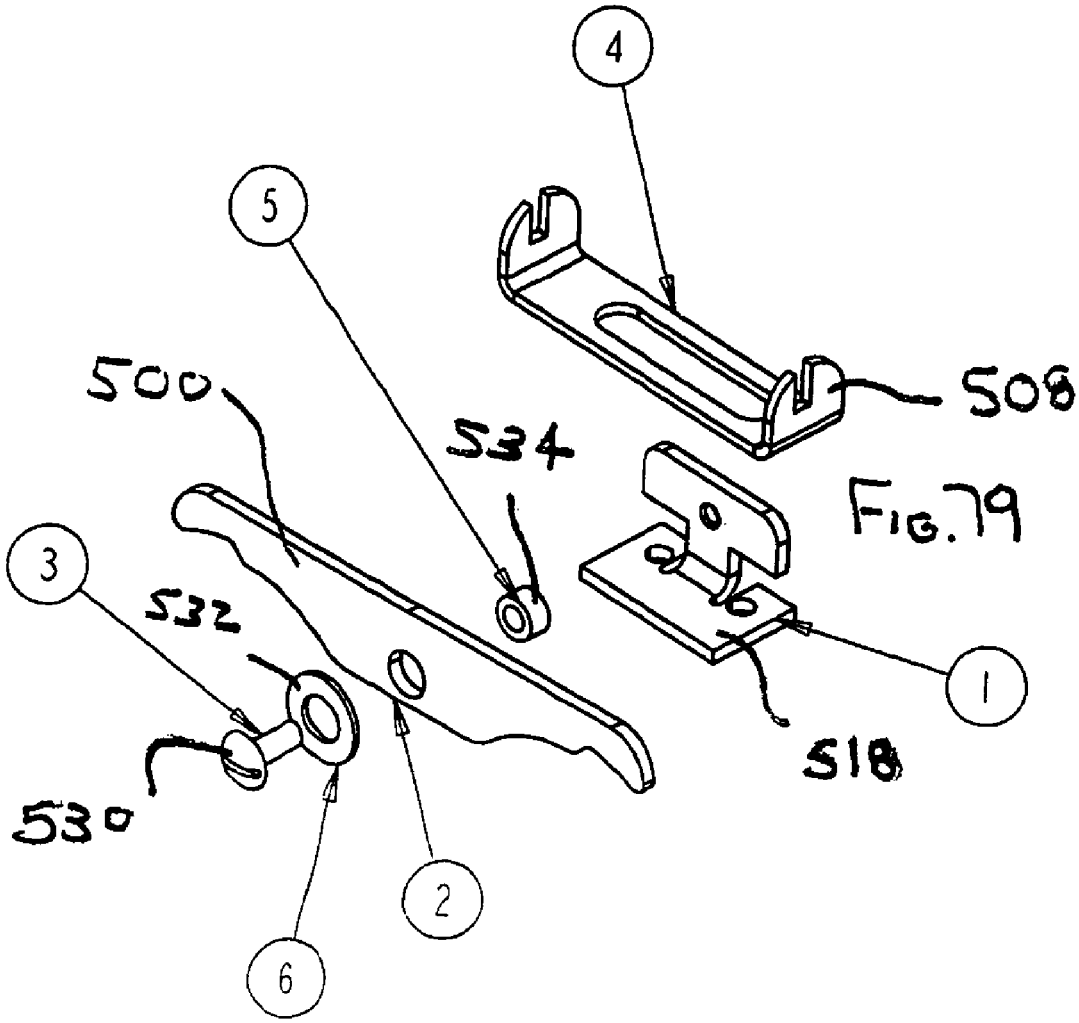
FIG. 79 is an exploded perspective view of an alternative interlock construction employing the rocker member of FIGS. 69-71, the slide member of FIGS. 72-74, and the mounting member of FIGS. 75-78.
Figure 80:
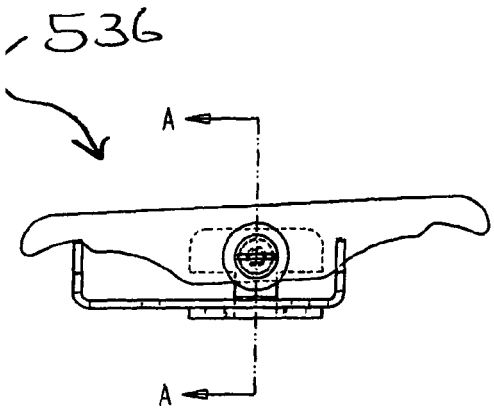
FIG. 80 is a front elevation of the assembled alternative interlock construction of FIG. 79.
Figure 81:
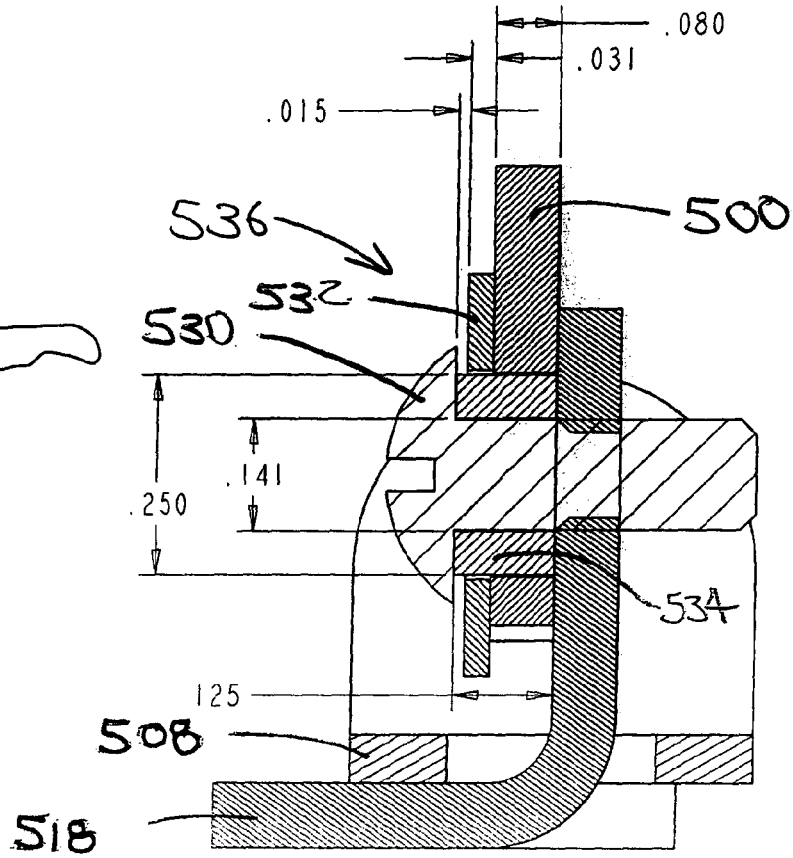
FIG. 81 is a side elevation, in section, of the alternative interlock construction of FIG. 79, taken along line A-A of FIG. 80.
Figure 82:
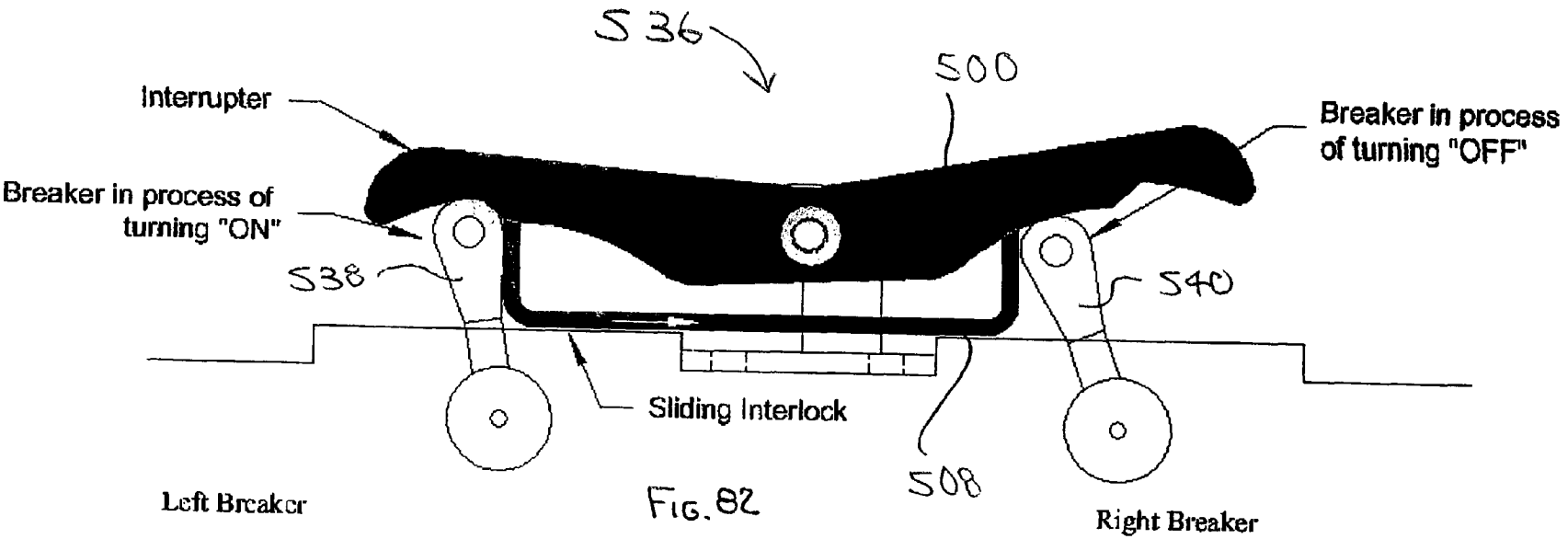
FIG. 82 is a schematic illustration of the alternative interlock construction of FIGS. 79-81, shown at a position corresponding to the beginning of a transfer process.
Figure 83:
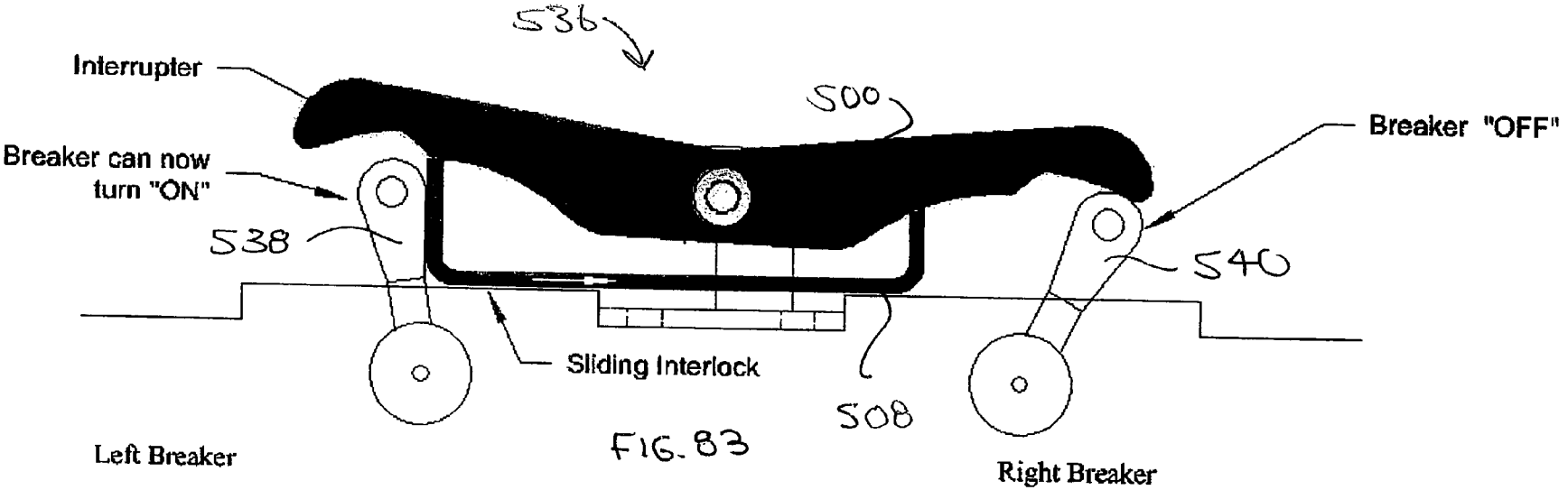
FIG. 83 is a schematic illustration of the alternative interlock construction of FIGS. 79-81, shown at a position corresponding to a position generally midway in a transfer process.
Figure 84:
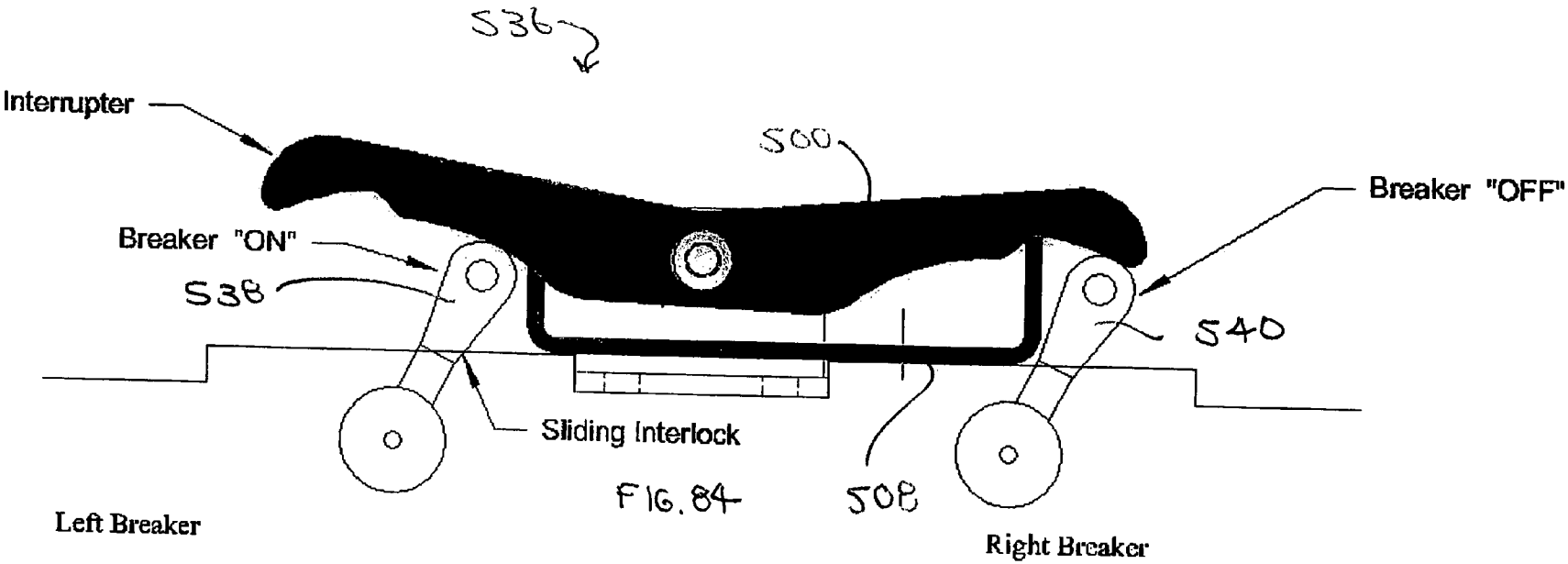
FIG. 84 is a schematic illustration of the alternative interlock construction of FIGS. 79-81, corresponding to a position at the completion of the transfer process.

FIG. 61 illustrates a representative electrical wiring schematic for a traffic signal transfer switch for a single phase circuit, with no neutral breakers. Transfer switch 400 will be fitted into an aperture in the housing of traffic signal controller 4, and "pilot light" 450, which may be in the form of a LED light, is positioned on the top or other advantageous position, on the outside of the housing for traffic signal controller 4. As can be seen from the schematic of FIG. 61, pilot light 450 will only be illuminated when the breaker switch connected to the utility is in its "OFF" position, and utility power is actually available, to thus provide an indication, without having to closely approach traffic signal controller 4, or open the cover to traffic signal transfer switch 4.

FIGS. 69-84 illustrate an alternative rocker construction which is provided, to enable enhanced control over the transfer process. Many breakers have switch handles that have a wide actuation range; that is, e.g., a switch may be in its "OFF" position at 60°, but it may not reach its top dead center position (at which point the spring bias will flip over to drive the switch to its "ON" position) until approximately 90° (perpendicular to the face of the breaker), and may not actually arrive at its "ON" position, until approximately 120°. With such breakers, it is usually not an issue that the "break" of one circuit will be accomplished (and the arc extinguished), long before the other circuit connection is "made". However, some breakers have a much narrower actuation range, in that "ON", top dead center (flip-over point) and "OFF" are all very close to 90°. Electrical codes typically require that the arc from the breaker being switched to "OFF" must be fully extinguished, before the arc begins for the breaker being switched to "ON". The arcs actually begin and end for a finite time before and after, respectively, a breaker switch arrives at its "ON" and "OFF" positions, respectively.

The alternative breaker configuration of FIGS. 69-84 provides for a further added measure of control over the movements of the breaker switches, so that it is assured that the breaker being switched "ON" cannot be actuated or brought close to the arc initiation, before the arc from the breaker being switched to "OFF" is fully extinguished.

Interlock 536 includes rocker member 500, having interference surfaces 502, outer cam surfaces 504 and inner cam surfaces 504; slide member 508, having web 510, end faces 512, notches 514 (for receiving rocker member 500), and slot 516 (to permit slide member 508 to move back and forth); and mounting member 518, having base 520, apertures 522, vertical flange 524 and aperture 526. Upon assembly, bolt 530 passes through washers 532 and 534, and is threaded into aperture 526, so that while slide member 508 is free to move from side to side, rocker member 500 is free to pivot, in a manner shown in FIGS. 82-84.

Specifically, as "OFF" breaker switch handle 538 is pushed, from left to right, toward its "ON" position (see FIG. 82), handle 538 moves to the left along outer cam surface 504 until it encounters interference surface 502, and the left end face 512 of slide member 508. Rocker member 500 cannot pivot, until/unless slide member 508 moves to the right, upon being pushed to the right by handle 538. In a coordinated movement, while slide member 508 moves to the right and rocker member 500 pivots clockwise, the right end face of slide member 508 pushes handle 540 until it reaches top of its arc, sliding along the underside of right inner cam surface 506, until right interference cam surface, at which point, right breaker switch handle 540 is free to move to its fully "OFF" position, under the impetus of its spring bias. This occurs, in FIG. 83, long before left breaker switch 538 has yet reached the top of its arc, and can move to its "ON" position.

While this interlock construction is described with respect to breakers having the "tight" movement ranges where ON, OFF and top dead center are all near the 90° position, it can be readily modified to be used with other more forgiving breakers, simply by adjustment of the cam and interference surfaces, relative to the length and range of movement of the slider member, by one of ordinary skill in the art having the present disclosure before them, without departing from the scope of the invention.

The foregoing description and drawings merely explain and illustrate the invention, and the invention is not so limited as those skilled in the art who have the disclosure before them will be able to make modifications and variations therein without departing from the scope of the invention.

| LISTING OF ELEMENTS BY REFERENCE NUMERAL | |
|---|---|
| 2 | utility power |
| 4 | traffic signal controller |
| 6 | traffic signal |
| 8 | portable power generator |
| 10, 10', 10'' | traffic signal transfer switch |
| 12 | male power inlet |
| 14, 14', 14'a, 14'b, 14'' | circuit breaker |
| 15 | single-pole, double-throw switch |
| 16, 16', 16'a, 16'b, 16'' | circuit breaker |
| 18 | interlock/lockout mechanism |
| 20, 20' | pilot light |
| 22, 22' | pilot light circuit breaker |
| 24 | neutral generator breaker |
| 26 | neutral utility breaker |
| 28 | interlock/lockout device |
| 30 | end cap |
| 32 | end cap |
| 33 | front surface |
| 34 | machine screws |
| 36 | handle lockout |
| 38 | pin |
| 40 | pin |
| 42 | web |
| 44 | web |
| 46 | notch |
| 50 | housing |
| 52 | top |
| 53 | top face |
| 54 | side |
| 56 | side |
| 58 | back |
| 60 | hinged front |
| 61 | front surface |
| 62 | hinged bottom |
| 64 | side flange |
| 66 | side flange |
| 68 | rivet |
| 70 | side flange |
| 72 | side flange |
| 74 | bottom flange |
| 76 | flange |
| 78 | flange |
| 80 | flange |
| 82 | flange |
| 86 | lock |
| 88 | flange |
| 90 | bolt |
| 92 | faceplate |
| 94 | pilot light |
| 96 | seal |
| 100 | opening |
| 102 | slot |
| 104 | slot |
| 110 | faceplate |
| 112 | front plate |
| 114 | bottom plate |
| 116 | side mounting flange |
| 118 | side mounting flange |
| 120 | bottom mounting flange |
| 122 | notch |
| 124 | notch |
| 126 | aperture |
| 127 | bore |
| 128 | aperture |
| 130 | aperture |
| 132 | aperture |
| 200 | flush-mounted transfer switch |
| 202 | housing |
| 204 | gasket |
| 206 | hinge |

-continued

| LISTING OF ELEMENTS BY REFERENCE NUMERAL | |
|---|---|
| 208 | cover |
| 210 | lock |
| 212 | face plate |
| 214 | housing side mounting flange |
| 216 | housing mounting bottom flange |
| 218 | housing side mounting flange |
| 220 | power inlet |
| 222 | breaker switches |
| 224 | lockout mechanism |
| 226 | locking bolt |
| 228 | housing mounting top flange |
| 230 | face plate mounting flange |
| 232 | rear wall |
| 234 | flange |
| 236 | flange |
| 238 | flange |
| 240 | flange |
| 241 | elongated member |
| 242 | channel |
| 244 | channel |
| 246 | channel |
| 300 | traffic signal controller cabinet/wall |
| 302 | aperture |
| 400 | traffic signal transfer switch |
| 402 | housing |
| 404 | gasket |
| 406 | hinge |
| 408 | cover |
| 410 | lock |
| 412 | face plate |
| 414 | housing mounting side flange |
| 416 | housing mounting bottom flange |
| 418 | housing mounting side flange |
| 420 | power inlet |
| 422 | breaker switch |
| 424 | interlock |
| 426 | locking bolt |
| 428 | housing mounting top flange |
| 430 | face plate mounting flange |
| 432 | housing rear wall |
| 434 | flange |
| 436 | flange |
| 438 | flange |
| 440 | flange |
| 442 | cord access opening |
| 444 | cord access door |
| 446 | mounting tab |
| 448 | hinge structure |
| 450 | hinge pin |
| 452 | power inlet cord and plug |
| 454 | opening |
| 456 | pilot light |
| 500 | rocker member |
| 502 | interference surface |
| 504 | outer cam surface |
| 506 | inner cam surface |
| 508 | slide member |
| 510 | web |
| 512 | end face |
| 514 | notch |
| 516 | slot |
| 518 | mounting member |
| 520 | base |
| 522 | aperture |
| 524 | vertical flange |
| 526 | aperture |
| 530 | bolt |
| 532 | washer |
| 534 | washer |
| 536 | assembled interlock |
| 538 | breaker handle |
| 540 | breaker handle |

What is claimed is:

1. A switch interlock apparatus, for functionally interconnecting at least two handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, the switch interlock apparatus comprising:

an elongated slider member, having a longitudinal axis and first and second end faces, operably configured to slidably move between the handles;

a rocker member, operably disposed to pivot about an axis disposed perpendicular to the longitudinal axis of the elongated slider member, the rocker member having two inner cam surfaces adjacent the pivot axis, two outer cam surfaces distal to the pivot axis, and two interference surfaces disposed between the respective inner and outer cam surfaces;

the rocker member being operably configured so as to engage the respective handles, toward movement in cooperation with the slider member, so as to engage the handle of a breaker which is being moved from an "OFF" position to an "ON" position, and prevent its movement to a top dead center position, before a corresponding breaker has moved from its respective "ON" position to its respective "OFF" position.

* * * * *